US005152511A

United States Patent [19]

Shido et al.

[11] Patent Number: 5,152,511

[45] Date of Patent: Oct. 6, 1992

[54] SHEET SORTER WITH STAPLER

[75] Inventors: Hironori Shido; Jun Saito, both of Kawasaki; Masakazu Hiroi, Yokohama; Kenji Kobayashi, Tokyo; Koichi Murakami, Yokohama; Masataka Naito; Takeshi Honjo, both of Kawasaki, all of Japan

[73] Assignee: Canon Kabushiki Kaisha, Tokyo, Japan

[21] Appl. No.: 807,408

[22] Filed: Dec. 12, 1991

Related U.S. Application Data

[63] Continuation of Ser. No. 662,973, Feb. 28, 1991, abandoned, which is a continuation of Ser. No. 226,064, Jul. 29, 1988, abandoned.

[30] Foreign Application Priority Data

| | | | |
|---|---|---|---|
| Jul. 30, 1987 | [JP] | Japan | 62-191934 |
| Jul. 30, 1987 | [JP] | Japan | 62-191936 |
| Jul. 30, 1987 | [JP] | Japan | 62-191937 |
| Jul. 30, 1987 | [JP] | Japan | 62-191938 |
| Aug. 7, 1987 | [JP] | Japan | 62-197786 |
| Aug. 10, 1987 | [JP] | Japan | 62-200288 |
| Aug. 10, 1987 | [JP] | Japan | 62-200289 |

[51] Int. Cl.[5] ..... B42B 1/02

[52] U.S. Cl. ..... 270/53

[58] Field of Search ..... 270/52, 53, 58, 37

[56] References Cited

U.S. PATENT DOCUMENTS

| | | | |
|---|---|---|---|
| 3,685,712 | 8/1972 | Turner et al. . | |
| 3,884,408 | 5/1975 | Leiter et al. . | |
| 3,994,427 | 11/1976 | Ganatsiou . | |
| 4,083,550 | 4/1978 | Pal . | |
| 4,134,672 | 1/1979 | Burlew et al. . | |
| 4,281,920 | 8/1981 | Cross . | |
| 4,295,733 | 10/1981 | Janssen et al. . | |
| 4,376,529 | 3/1983 | George et al. . | |
| 4,382,592 | 5/1983 | Harding | 270/53 |
| 4,497,478 | 2/1985 | Reschenhofer et al. . | |
| 4,566,782 | 1/1986 | Britt et al. . | |
| 4,681,310 | 7/1987 | Cooper | 270/53 |
| 4,684,241 | 8/1987 | Acquaviva . | |
| 4,687,191 | 8/1987 | Stemmle | 270/53 |
| 4,762,312 | 8/1988 | Ushinogata | 270/53 |
| 4,787,616 | 11/1988 | Sasaki et al. . | |

FOREIGN PATENT DOCUMENTS

| | | | |
|---|---|---|---|
| 0099250 | 9/1984 | European Pat. Off. . | |
| 0198979 | 10/1986 | European Pat. Off. . | |
| 57-137263 | 8/1982 | Japan . | |
| 58-220053 | 12/1983 | Japan . | |
| 59-86551 | 5/1984 | Japan . | |
| 59-185355 | 10/1984 | Japan . | |
| 62-119069 | 4/1987 | Japan . | |
| 2126997 | 4/1984 | United Kingdom . | |
| 2168037A | 6/1986 | United Kingdom | 270/53 |

OTHER PUBLICATIONS

Xerox Disclosure Journal, vol. 1, No. 4, Apr. 1976.

*Primary Examiner*—Edward K. Look
*Assistant Examiner*—Therese M. Newholm
*Attorney, Agent, or Firm*—Fitzpatrick, Cella, Harper & Scinto

[57] ABSTRACT

A sheet sorting apparatus with a stapler includes a plurality of bin trays which are arranged substantially vertically with predetermined clearances between adjacent bin trays, which are inclined to provide an inclined sheet receiving surfaces and which are independently movable substantially in the vertical direction, wherein the bin trays are so disposed that those ends of adjacent ones of the bin trays which are closer to the sheet inlet are deviated when seen in a direction substantially perpendicular to the sheet receiving surface; bin tray shifting device for moving the plurality of the bin trays stepwisely substantially in the vertical direction to oppose the respective bin trays to a sheet inlet of the sorting apparatus; stapling device, disposed substantially on an extension of the inclined sheet receiving surface and having a stapling head movable to above the sheet receiving surface and an anvil movable to below the sheet receiving surface, for stapling the sheets interposed between the stapling head and the anvil; and a second shifting device for shifting the bin tray immediately above the bin tray opposed to the stapling device in a direction increasing the deviation, wherein the stapling head is moved using a space provided by the deviation, and wherein the expanded clearance is smaller than a height of the stapling head.

41 Claims, 33 Drawing Sheets

SHEET SORTER WITH STAPLER

This application is a continuation of application Ser. No. 662,973 filed Feb. 28, 1991, now abandoned, and parent application Ser. No. 226,064 filed Jul. 29, 1988 now abandoned.

FIELD OF THE INVENTION AND RELATED ART

The present invention relates to a postprocessor for processing sheets of paper, for example, the sheets discharged from an image forming apparatus such as a copying machine or a laser beam printer, more particularly to a sheet sorter provided with a number of bins for sorting and accommodating the sheets and with a stapler for stapling a stack or set of the sheets in each of the bins.

A postprocessor has been proposed wherein the sheets can be sorted and accommodated without limitation by the number of bins, which will hereinafter be called "limitless sorter", and wherein sets of the sheets are stapled in the respective bins.

For example, U.S. Pat. No. 3,884,408 discloses a horizontal limitless sorter of a stationary bin type wherein a carriage for carrying a stapler is movable to the respective bins, and the stapler is rotated away from the carriage to staple a stack of sheets.

Japanese Laid-Open Application Nos. 220053/1983 and 185355/1984 disclose a limitless sorter wherein a stapler block moves substantially vertically, expands the space between adjacent bins and inserts a stapling head into the space to staple the stack of sheets.

U.S. Pat. No. 4,295,733 discloses a limitless sorter wherein a set of sheets are gripped by a gripper and is transported to a stapler by which it is stapled.

Those limitless sorter, however, involves a problem that a stapling operation is time consuming, and it is difficult to increase the stapling operation speed, and a problem that the structure of the apparatus is complicated with the result of high cost. In addition, since the space between adjacent bins has to be expanded enough to allow access of the stapler to the sheets, the bulkiness of the apparatus results.

SUMMARY OF THE INVENTION

Accordingly, it is a principal object of the present invention to provide a sheet sorting apparatus wherein a stapling operation can be performed smoothly.

According to an embodiment of the present invention, a stapler is inserted into the space between a bin stacking a set of sheets to be stapled and an adjacent bin, at which the leading edge (the edge closer to an apparatus from which the bin receives the sheets) of a sheets stacking surface of the bin stacking the sets of sheets to be stapled is deviated from the leading edge of the sheet stacking surface of the adjacent bin.

According to another embodiment, bin intervals between a bin at the stapling position and an upper bin is expanded, in addition to the above feature.

The sheets discharged from the apparatus are sorted and accommodated in the number of bins, and when the number of the sheets accommodated in the bin reaches a predetermined number, the stapler moves toward the deviated portion and staples the set of sheets.

Since the set of sheets to be stapled and the adjacent set of sheets is deviated because of the deviation with the upper bin described above, there is no member obstructing the stapler above the end of the bin presented for stapling, and therefore, the stapling operation can be performed smoothly.

According to another embodiment, helical cam means having a helical groove is used for driving the bins, together with guiding means for guiding the bin movement in the vertical direction. The grooves of the cams at the lateral sides are directed in opposite directions, and the cam means are rotated in the opposite directions, so the bins can be moved smoothly in the vertical direction.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1:
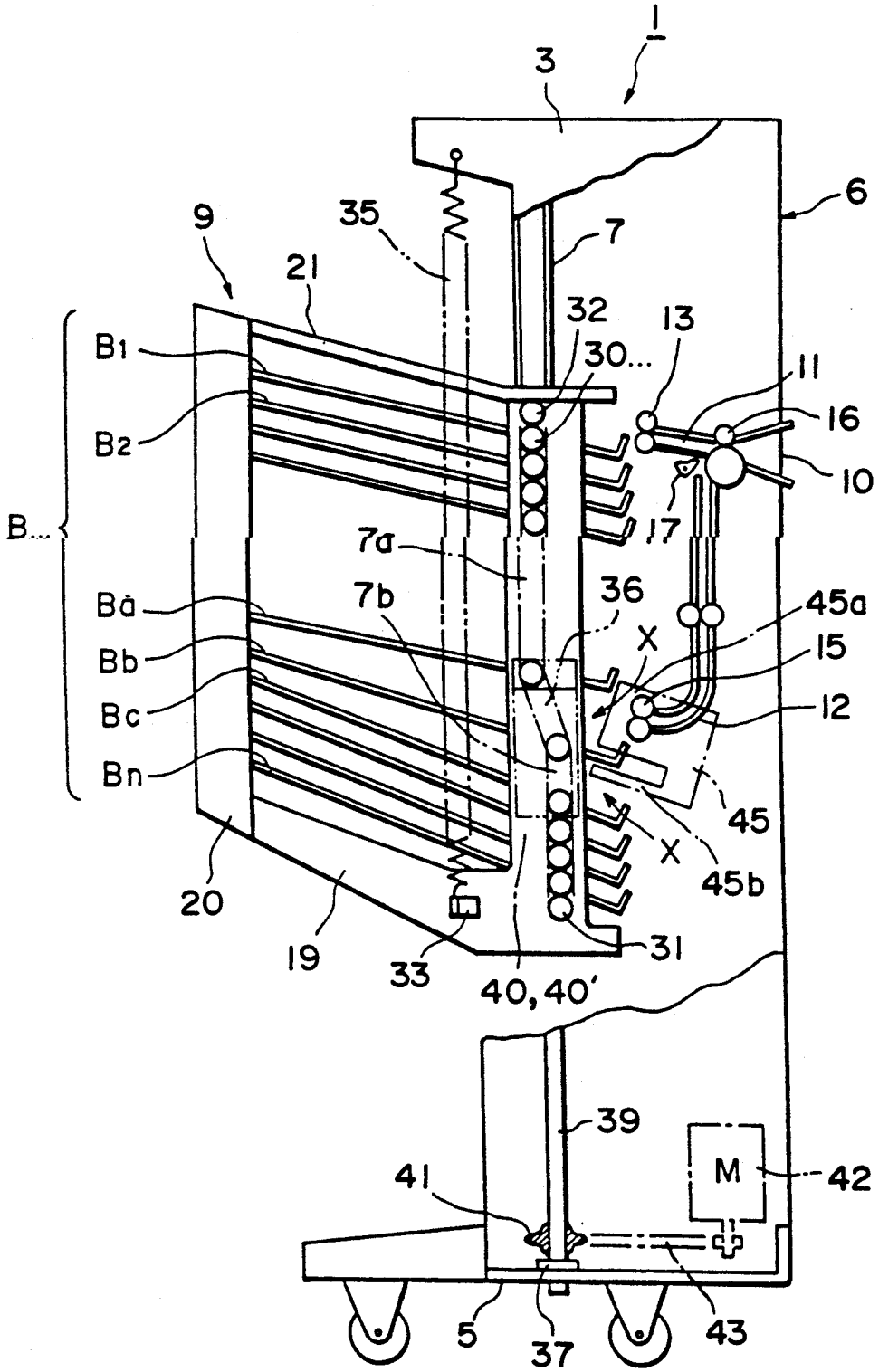
FIG. 1 is a side view of a sorter according to an embodiment of the present invention.

Referring to FIG. 1, there is shown a sorter according to an embodiment of the present invention. As shown in this Figure, the sorter 1 comprises a main assembly 6 including a pair of side plates 3, a base 5 and a cover 4. The sorter further comprises a bin unit 9 having a number of bins B and movable substantially vertically along guide rails 7 mounted on the respective side plates 3.

The main assembly 6 of the sorter 1 is provided with a sheet inlet 10 for receiving sheets from a copying machine or the like, and a first sheet passage 11 is formed extending from the sheet inlet 10 toward the bin unit 9. A second sheet passage 12 is formed branching out of the first sheet passage 11. Downstream of the first sheet passage 11 with respect to the movement direction of the sheet, an upper discharging roller couple is disposed to discharge the sheets not to be sorted. Downstream of the second sheet passage 12, a pair of discharging rollers 15 is disposed to discharge the sheets to be sorted. A receiving roller pair 16 and a deflector 17 are provided at the branch between the first and second sheet passages 11 and 12. The deflector 17 is selectively displaceable either to direct the sheet discharged by the upper discharging pair couple 13 toward the bin B to the first sheet passage 11 or to direct the sheet discharged by the lower discharging rollers 15 to the bin B to the second sheet passage 12. The bin unit 9 includes a bin supporting frame 19 having vertical portions 19*a* and a bottom portion 19*b*. The bin supporting frame 19 has a bin slider 20 mounted thereto at an end thereof, and the bin supporting frame 19 and the bin slider 20 are securedly fixed by a bin cover 21.

Figure 2:
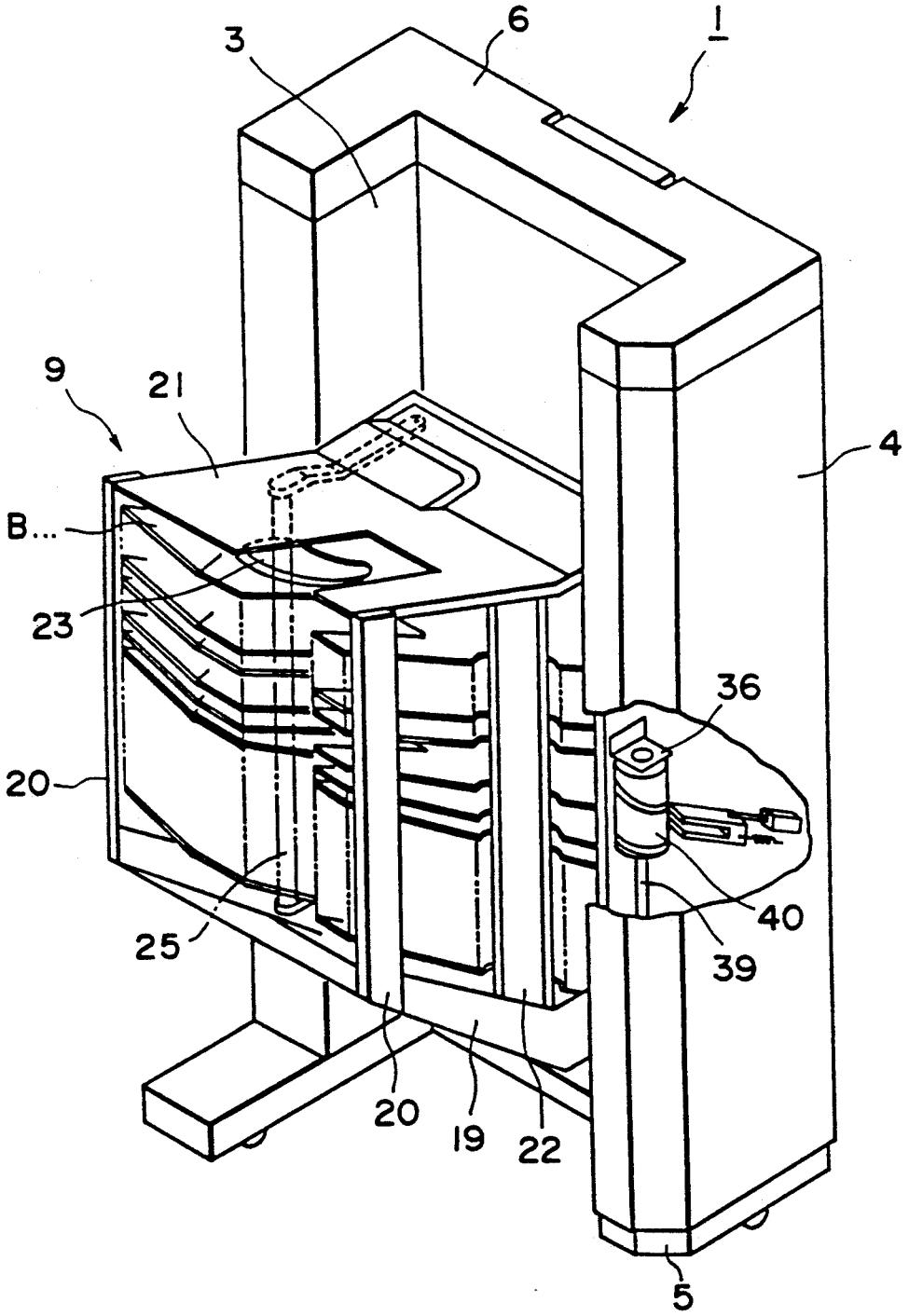
FIG. 2 is a perspective view thereof.
Figure 3:
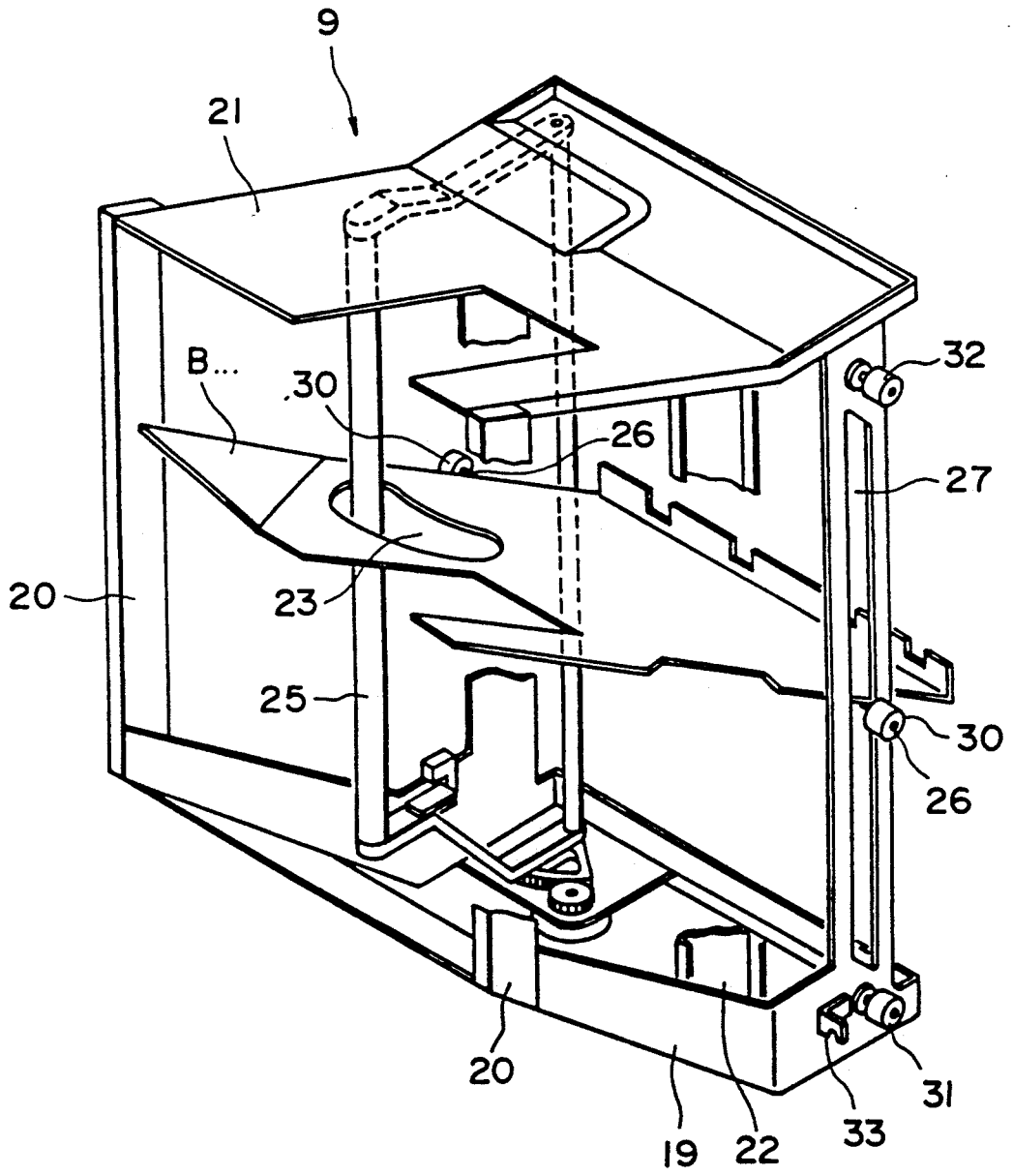
FIG. 3 is a perspective view of a bin unit.

As shown in FIGS. 2 and 3, a reference member 22 for alignment of the sheets is extended between and fixed to the bin cover 21 and the bottom portion 19*b* of the bin supporting frame 19. A swingable aligning rod 25 is extended through a cutaway portions 23 formed in all of the bins B. The sheets received by the bins B are abutted to the reference member 22 by the swinging movement of the aligning rod 25 to align the sheets.

Figure 4:
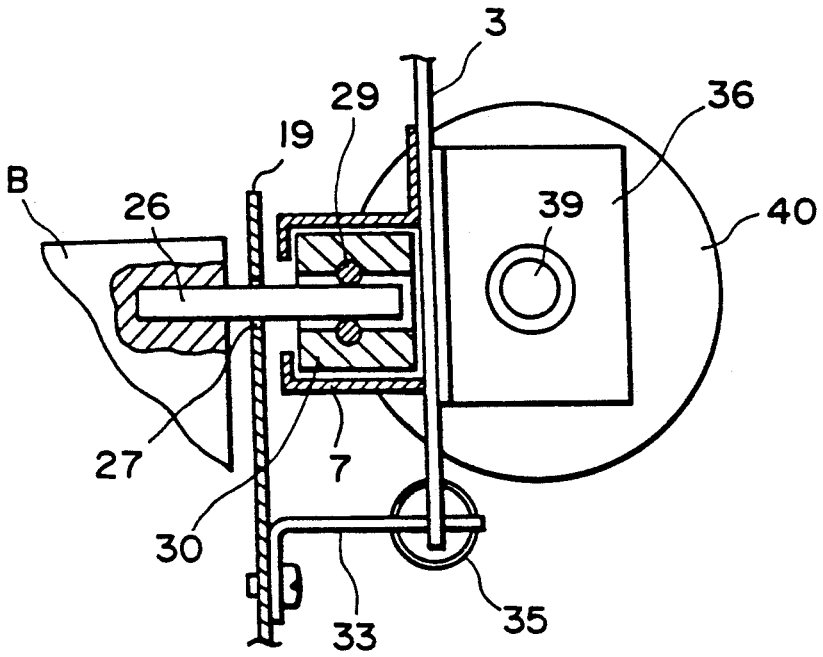
FIG. 4 is a top plan view illustrating engagement between a lead cam and a trunnion.

Each of the bins B accommodated in the bin unit 9 is movably supported in a comb-like channel of a bin slider 20 at an end thereof, and at both sides at the base side thereof, it has pins 26 fixed thereto, as shown in FIG. 4. The pin penetrates through a slit 27 formed in the bin supporting frame 19. To the pin 26 penetrated through the slit 27, a trunnion 30 is rotatably mounted through a cushion O-ring 29. The trunnions 30 of the bins B are stacked in the guide rail 7. The bottommost trunnion 30 is contacted to a lower guide roller 21 rotatably supported on the bin frame 19. The topmost trunnion 30 is contacted to the upper guide roller 32 rotatably supported on the bin supporting frame 19, so that each of the bins B is supported in the bin unit 9 with intervals between adjacent bins equal to the diameter of the trunnions 30.

As shown in FIG. 1, the upper guide roller 32 and the lower guide roller 31 are engaged with the guide rail 7, so that the bin unit 9 is movable substantially vertically. A spring 35 is stretched between a member 33 mounted to the bin supporting frame 19 of the bin unit 9 and a side plate 3 of the main assembly 6 of the sorter to normally urge the bin unit upwardly.

On each of the side plates 3, a cam shaft holder 36 is mounted at a position corresponding to the above described lower discharging rollers 15, as shown in FIG. 1 and 2. Between the cam shaft holder 36 and the base 5, a lead cam shaft 39 is rotatably mounted by means of a bearing 37. Above each of the lead cam shafts 39, lead cams 40 and 40′ each having a helical cam surface is fixedly mounted. Below it, a sprocket 41 is fixedly mounted between the sprocket 41 and a shift motor 42, and a chain 43 is trained thereon, so that the lead cams 40 and 40′ are selectively rotated in a forward or a backward direction by selectively rotating the shift motor 42 in a forward or a backward rotation.

Each of the lead cams 40 and 40′ is disposed faced to the lower discharge couple 19 disposed substantially at the center of the main assembly 6 of the sorter, and functions to carry on its helical cam surface the trunnion 30 of a bin B moving toward the position faced to the lower discharging rollers 15 to move it along the guide rail 7 in the vertical direction. By this, at a position facing to the lower discharging rollers 15, an expanded space X which is larger than the intervals between other adjacent bins B is formed.

Figure 5A:
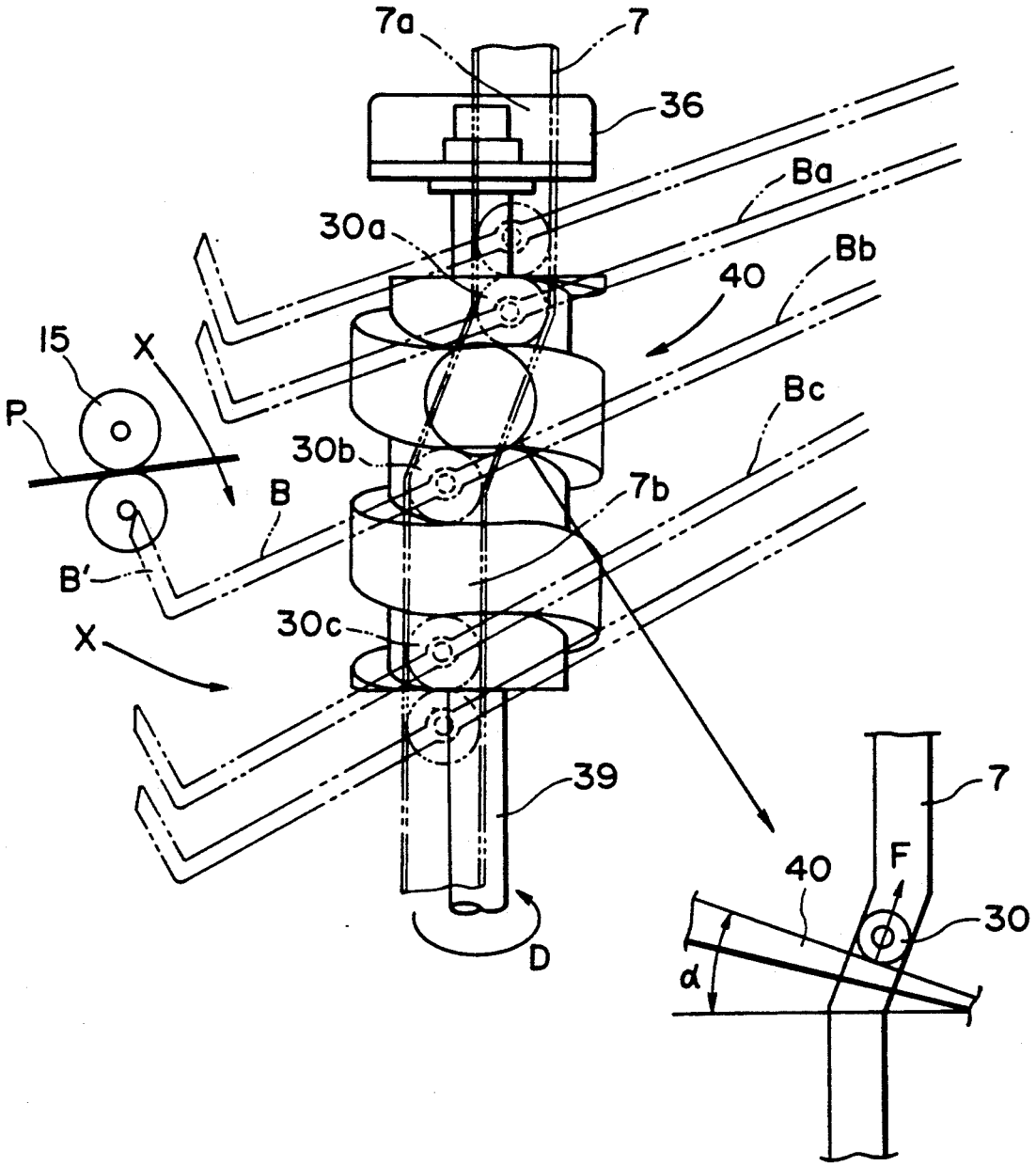
FIG. 5A is a side view illustrating movement of bins by the lead cam as seen in the direction indicated by an arrow V(a) in FIG. 6.
Figure 5B:
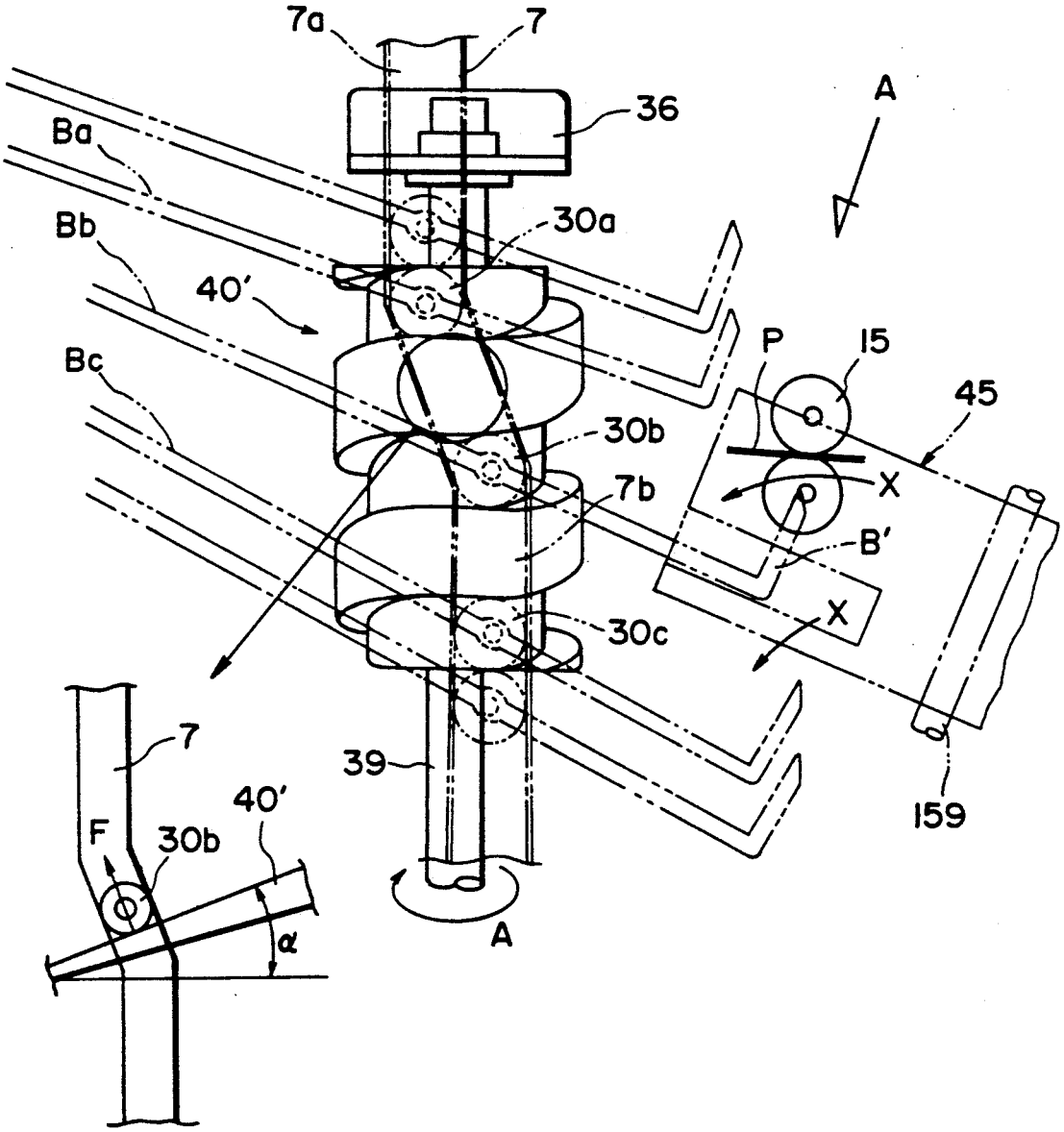
FIG. 5B is a side view illustrating movement of the bins by another lead cam, as seen in the direction indicated by an arrow V(b) in FIG. 6.

On the other hand, the guide rail 7 formed in each of the side plates 3 has a configuration, as shown in FIGS. 1 and 5A and 5B, that is, it generally extends from the bottom to the top, and is bent away from the lower discharging roller couple 15 at a position faced to the lead cams 40 and 40′.

When the trunnion 30 is introduced along the guide rail 7, the bin Ba, for example, is guided along the lower portion 7*b* of the guide rail 7 adjacent to the lower discharging roller pair 15 and receives the sheet P discharged from the lower discharge rollers 15 without the trailing edge portion of the sheet P remained on the stopper B′. After it receives the sheet, it is moved upwardly along the rail (toward the upper portion 7*a* of rail, avoiding the interference with the discharging roller couple 19, therefore, the sheet B accommodated thereon is not interfered with by the lower discharging rollers 15. As described above, according to this embodiment of the present invention, the guiding means is so constructed that either of the trunnion not moved by the helical cam means and the trunnion moved by the helical cam means is shifted with respect to the other of them downwardly with respect to sheet discharge direction. Therefore, when the bin receives the sheet, it is close to discharging means, whereas after it receives the sheet, it avoids the interference with the sheet discharging means by shifting downwardly, so that the sheet is prevented from being carried on the trailing edge stopper of the bin, or is prevented from jamming. In addition, a head of a stapler may be disposed at the shifting position, so that the head can be disposed without interference with the base portion of the bin, whereby the sheet sorter is easily equipped with a stapler.

Figure 6:
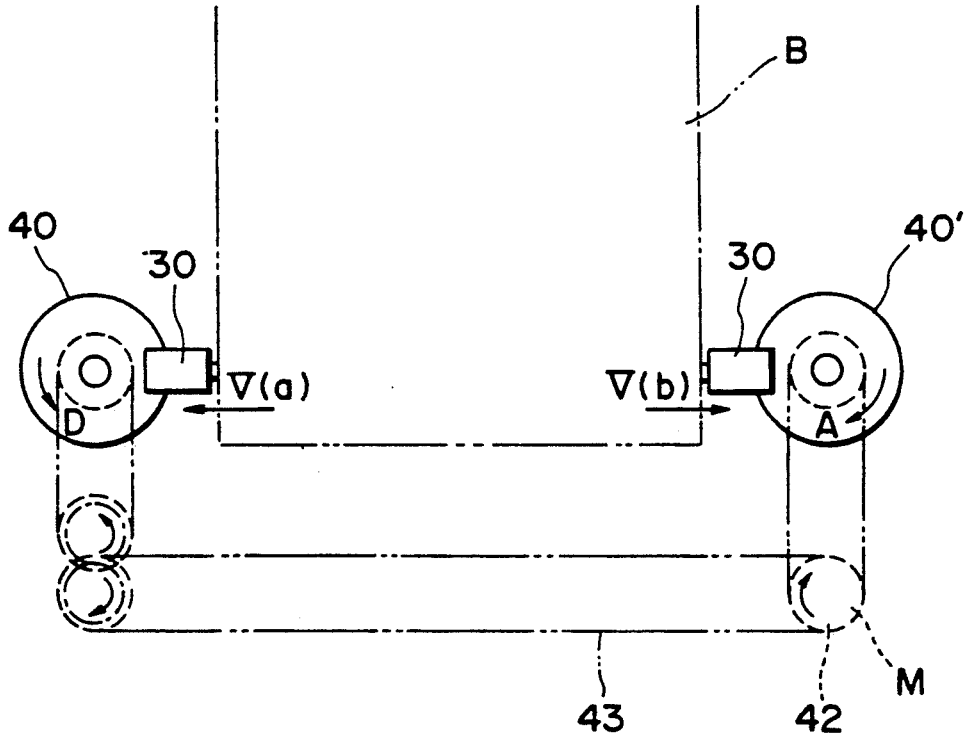
FIG. 6 is a top plan view illustrating a driving mechanism for the lead cams.

The description will be made as to the construction of the lead cams 40 and 40'. The lead cams 40 and 40' are helical in different directions, as shown in FIGS. 5A and 5B. As shown in FIG. 6, the lead cam 40 and the lead cam 40' disposed at lateral sides provide driving forces in different directions.

Further, the cam configurations of the lead cams 40 and 40' are such as to provide two (upper and lower) expanded portions X, simultaneously. The sheet being discharged through the lower discharging roller couple 15 is discharged to and is accommodated by the bin B faced to the lower discharging roller couple 15 through the upper expanded space X. Since the expanded spaces are simultaneously formed at two portions, the electric stapler unit 45 can be inserted for the bin B without an interference of the head 45*a* and the anvil 45*b* thereof unnecessarily interfering with the sheet (FIG. 1).

It has been found that if the trunnions at the both sides 30 and 30 are driven by lead cams 40 and 40' which have the same configuration and which are rotated in the same rotational direction, unlike the present invention, the problem arises.

Figure 7:
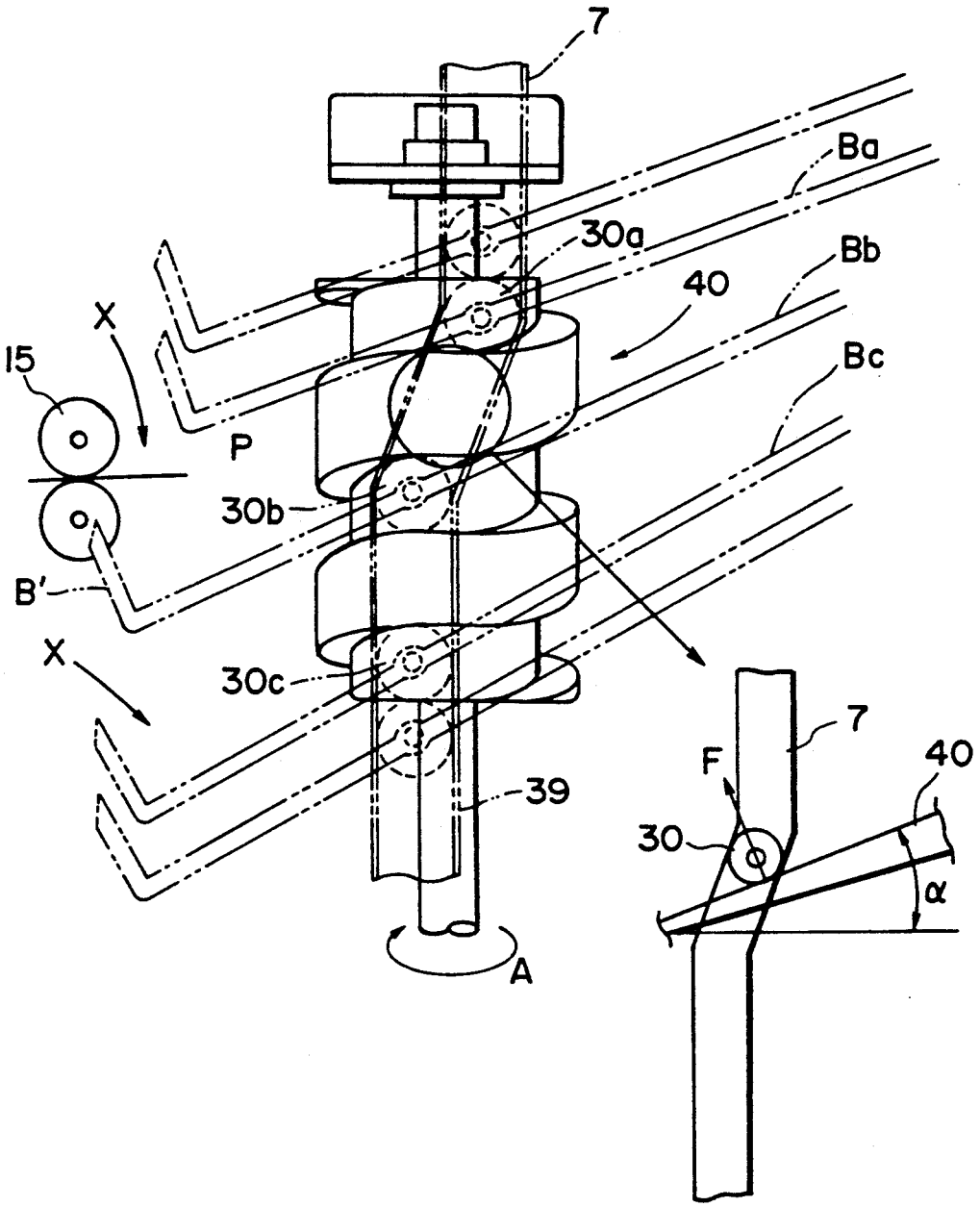
FIG. 7 is a side view illustrating bin movement by the same configuration lead cams, as seen in the direction indicated by an arrow VII(a) in FIG. 8.
Figure 8:
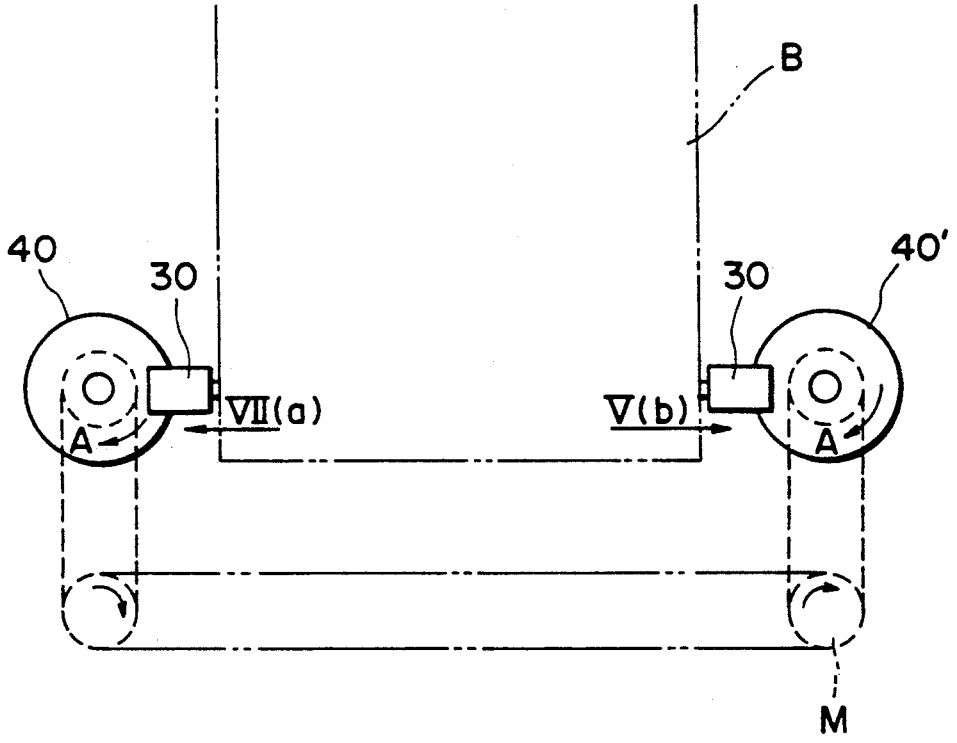
FIG. 8 is a top plan view illustrating a driving mechanism for the lead cams.

FIG. 8 shows a relationships between a left side lead cam 40 and the trunnion 30 driven by the lead cam 40. The bin Bb placed at the position faced to the lower discharging roller couple 15 and the trunnion 30*b*, as shown in FIG. 7A, is moved by the lead cam 40 rotating in the direction of an arrow A from the position faced to the lower discharging roller couple 15 to the position of the trunnion 30*a* of the bin Ba shown in this Figure as an upper adjacent bin. During this movement, a trunnion 30*b* receives from the lead cam 40 a force F (FIG. 7B) which is perpendicular to the inclination angle $\alpha$ of the helical cam surface of the lead cam 40, so that a large load is imposed to the trunnion 30*b* by the guide rail 7.

FIG. 8 also shows the relationships between the right hand lead cam 40' and the trunnion 30. Similarly, as shown in FIG. 5B, the trunnion 30*b* is moved by the lead cam 40' rotatable in the direction indicated by an arrow A from a position opposed to the lower discharging roller couple 15 to the position of the trunnion 30*a* of the bin Ba shown as an upper bin in this Figure. During this movement, the force F applied by the lead cam 40' is substantially along the bending direction of the guide rail 7 (FIG. 5D), so that the load applied by the guide rail 7 is reduced, so that the trunnion 30 is very smoothly moved. As described, if the lead cam is rotated in the same rotational direction, one side of the bin B is smoothly moved, whereas the other side is moved with a large load, and therefore, the movement of the bin B is not stabilized, so that noise is produced during movement of the bin, that the aligned sheets are disturbed on the bin B by vibration, and that the load of the shift motor 42 for driving the lead cam 40 and 40' is large.

According to the above described this embodiment of the present invention, the problem like this does not occur, since the lead cam 40 is rotated in the opposite rotational direction to the lead cam 40', and the cam configuration is opposite to move the bins in the same directions at both of the lateral sides by the opposite direction rotations of the lead cams 40 and 40'.

Referring further to FIG. 5B, the arrangement of the bins B will be described. The bin B is inclined downwardly toward the sheet inlet side, and is moved with the space with the adjacent bin being increased and decreased in response to the vertical movement of the trunnion 30. As will be understood from the Figure, a gap A is formed between the leading edge (the sheet inlet side) of the tray placed at a sheet receiving position and that of the bin thereabove, as seen from a direction substantially perpendicular to a sheet supporting surface of the bin. A similar gap is formed between the bin at the sheet receiving position and the bin below it.

A shaft 55 for swinging movement of the stapler extends substantially perpendicularly to the sheet supporting surface of the bin, so that the stapler 45 rotates in a plane substantially perpendicular to the sheet of the drawing of FIG. 5B. By this rotation, the stapler head 45*a* of the stapler 45 approaches the top surface of the stack of the sheets on the bin through the gap from a lateral side of the bin, and simultaneously, the anvil 45*b* approaches toward the bottom side of the stack of the sheets through a space between the bins.

Therefore, the space between the adjacent bins is not required to be larger than the height of the stapler head 45*a*, and the stapling operation is possible with the relatively small space between the bins.

In this embodiment, the bin is further shifted substantially in the horizontal direction, a larger stapler head can be used.

In operation, a sheet discharged from an image forming apparatus such as a copying apparatus is guided by a deflector 17 displaced on the basis of the selection between the non-sort mode and the sort mode, from the inlet selectively to the first sheet passage 11 or to the second sheet passage 12. When the nonsort mode is selected, the sheet is transported along the first sheet passage 11 and is discharged to the first bin B1 of the bin unit 9 by the upper discharging roller couple 13.

When the sort mode is selected, the trunnion 30 is sequentially moved by the helical cams of the lead cam 40 and 40' which are rotating, to provide an expanded space between bins B faced to the lower discharging roller couple 15, which space is larger than the space between adjacent bins. During this movement, the moving trunnion 30 presses the upper guide roller 32 and the lower guide roller 31 to move the unit 9 as a whole. The sheet is discharged through the second sheet passage 12 by the lower discharge roller couple 15 to the first bin B1, and then discharged to the bin B2.

As to the operation of the bin B moved adjacent to the lower discharging roller couple 15 when the sort mode is selected, the description will be made with the example of the bins Ba, Bb and Bc shown in FIGS. 5A and 5B.

The bins Ba, Bb and Bc moved to the neighborhood of the lower discharging roller couple 15 is moved along the guide rail 7 with the trunnions 30*a*, 30*b* and 30*c* carried on the helical cam surface of the lead cam 40. Between the bins Ba, Bb and Bc, expanded spaces X and X which are larger than the interval between the other adjacent bins is formed. The bin Bb having received the sheet discharged by the lower discharging roller couple 15 is moved to the position of the upper bin Ba, avoiding the lower discharging roller couple 15, with the trunnion 30*b* being moved along the bent guide rail 7 by the lead cam 40 rotating in the direction indicated by an arrow D and a lead cam 40' rotating in the direction indicated by an arrow A by the rotation of the shift motor 42.

The accommodating bin Bb moved close to the lower discharging roller couple 15 so as to assuredly receive the sheet P discharged by the lower discharging roller couple 15, is moved along the bent guide rail 7, so that it is not interfered with the lower discharging roller couple 15 after the sheet is accommodated.

When the trunnion 30*b* is moved along the bent portion of the guide rail 7, the trunnion 30*b* receives the force F from each of the lead cams 40 and 40', which is substantially along the bending direction of the guide rail 7 (FIGS. 5C and 5C). As a result, the bin B is efficiently moved, so that the load to the shift motor 42 is small, and also, the vibration of the bin B is small, and therefore, the sheets aligned on the bin B is not disturbed without production of noise.

Figure 9:
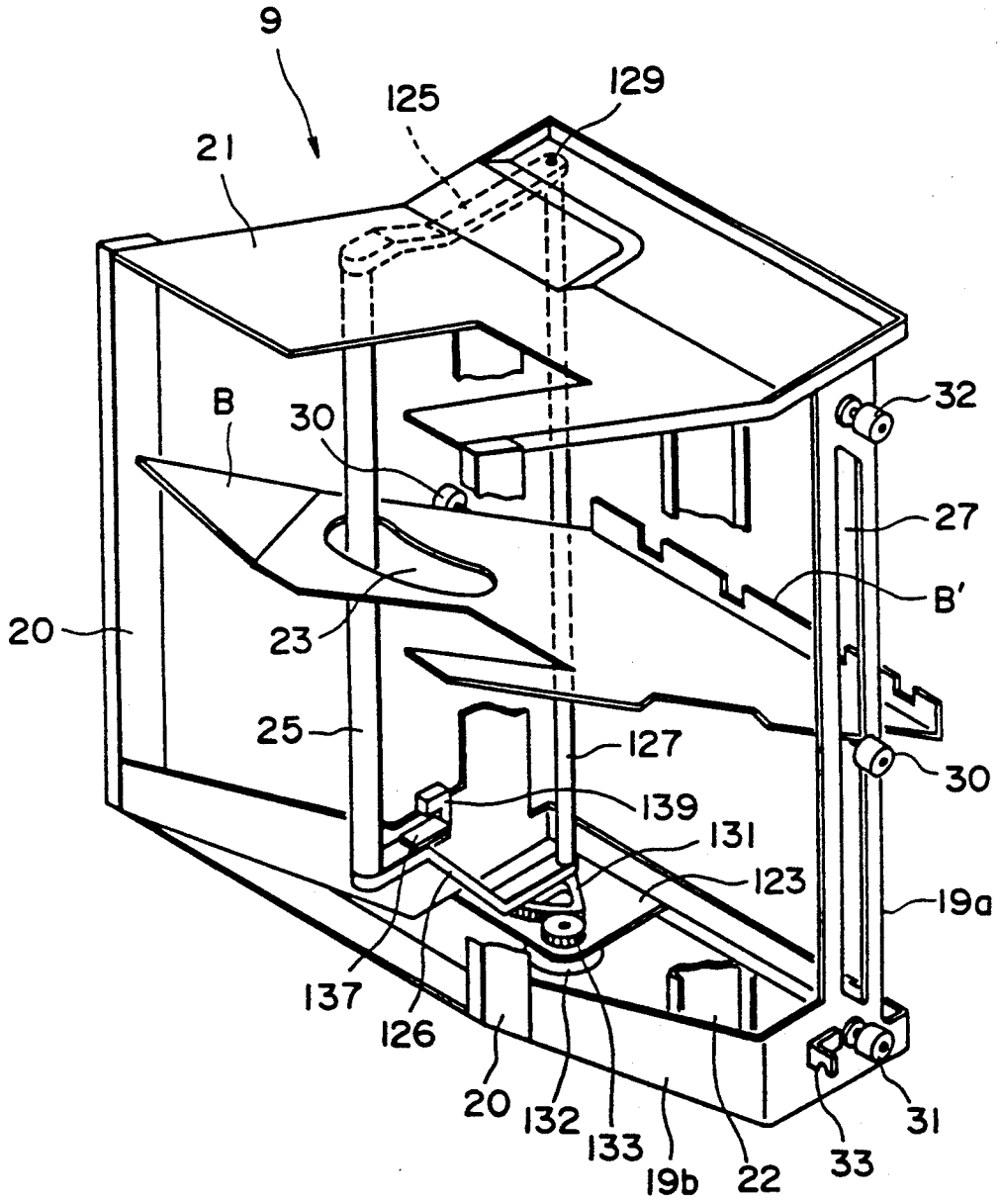
FIG. 9 is a perspective view of a bin unit illustrating driving means for an alignment means.

Referring to FIG. 9 the description will be made as to the stapler and alignment means, wherein the same reference numerals are assigned to the corresponding elements as in the foregoing embodiment, with the exception that in this Figure the slot 27 is shown as being straight for the sake of simplicity since this FIG. 9 is intended to illustrate the stapler and alignment means. A supporting frame 123 is fixed to the left side of the base portion of the bin frame 19. On the supporting plate 123, a rotation shaft 127 having an upper end fixed to an upper arm 125 and a lower end fixed to the lower arm 125 is rotatably mounted by an unshown rotational shaft mounted on the supporting plate 123 and by a rotational shaft 129 mounted on the bin cover 21. On the supporting plate 123, a sector gear 131 is rotatably supported about a rotational shaft mounted on the supporting plate 123, and said lower arm 126 is fixed to the sector gear. Further, below the supporting plate, a pulse motor 123 is disposed. A gear 133 fixed to the output shaft of the pulse motor 132 is meshed with the sector gear 131. An aligning rod 25 is extended between an end of the lower arm 126 and an end of the upper arm 125 and is penetrated through a cut-away portion 23 formed in all of the bins. The aligning rod 25 is swingable by the rotation of the sector gear 131. The lower arm 126 is provided with a light blocking point 137, which rotates integrally with the lower arm 126, whereby a home position sensor 139 disposed at the left side of the bin frame 19 is actuated.

Each of the bins B accommodated in the bin unit 9 is provided with trunnions 30 at the longitudinal base side ends. The trunnions are projected through slits formed in the vertical portions 19*a* of the bin frame of the trunnion 30 and are engaged with and stacked in the guide rails 7, in this embodiment. The bottommost trunnion 30 is in contact with the lower guide roller 31 rotatably supported on the vertical portion 19*a* of the bin frame 19, whereas the topmost trunnion is contacted to an upper guide roller 32 rotatably supported on the vertical portion 19*a* of the bin frame 19. Therefore, the bin B are supported in the bin unit 9 with the intervals therebetween equal to the diameter of the trunnions 30. The bin unit 9 is movable vertically along the guide rail with the upper guide roller 32 and lower guide roller 31 engaged with the guide rails 7.

Adjacent to the lower discharging roller couple 15, an electric stapler 45 for stapling the sheets accommodated on the bin B is disposed, which is provided with a solenoid 156 and a stapler spring 157. The electric stapler 45 is rotatable about a pivot 159, and is normally abutted to a stopper 160 to take a retracted position (solid line position) outside the sheet path. When the sheets S of the bin B is to be stapled, it is displaced to the chain line position to staple the sheets on the bin B opposed to the lower discharging roller couple 15.

Figure 10:
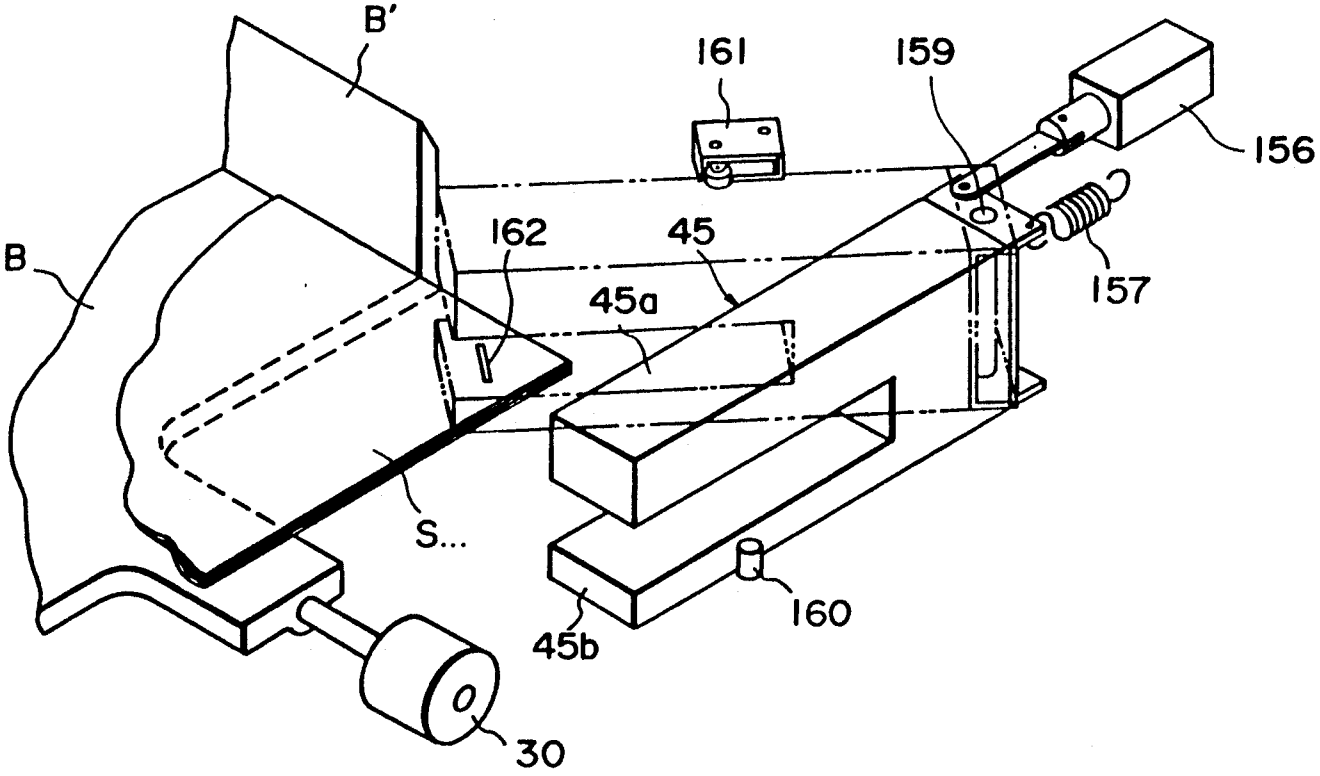
FIG. 10 is a perspective view illustrating arrangement of an electric stapler.

A microswitch 161 shown in FIG. 10 serves to detect the electric stapler 45 moved to the sheet stapling position.

In operation, the sheet S discharged from the image forming apparatus such as a copying machine is selectively directed to the first sheet passage 11 or to the second sheet passage 12 by the deflector 17 from the sheet inlet 10, depending on the mode selected from the non-sort mode and the sort mode.

When the non-sort mode is selected, the sheet is discharged to and received by the first bin B1 of the bin unit 9 by the upper discharging roller couple 13 through the first sheet passage 11.

When the sort mode is selected, the lead cam 40 rotates to sequentially move the trunnions 30 by the helical cam thereof to provide two expanded portion X and X with the bin B opposed to the lower discharging roller couple 15, the expanded portion being larger than the space between the other adjacent bins. By the moving trunnions 30, the upper guide roller 43 or the lower guide roller 42 is urged so that the bin unit 9 moves as a whole. The sheets S are discharged sequentially by the lower discharging roller couple 15 through the second sheet passage 12 and are received by the first bin B1 and the subsequent bins sequentially.

Figure 11:
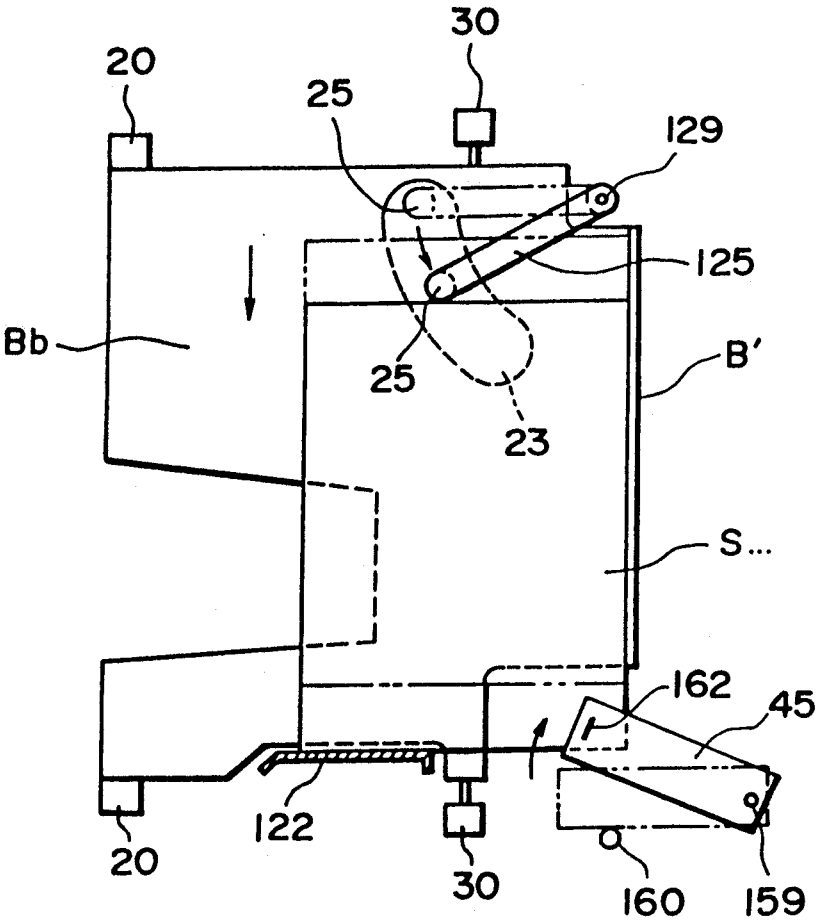
FIG. 11 is a top plan view illustrating operations of an electric stapler and an aligning rod.

As shown in FIG. 11, when the sheet S is discharged onto the bin Bb placed opposed to the lower discharging roller couple 15, the sheet S moves toward a trailing edge stopper B' by its own weight, since the trailing edge side of the bin Bb is inclined downwardly. In addition, the aligning rod 25 is moved from its retracted position 25' through a predetermined distance in the direction indicated by an arrow E by a pulse motor 132 rotated in accordance with a pulse signal corresponding to the size of the sheet, by which a lateral edge of the sheet S is abutted to an alignment reference member 122. The aligning rod 25 is returned to the retracted position to be prepared for the next sheet discharge, after it moves through the predetermined distance. By repeating the above operation, a plurality of sheets S are accommodated on a bin Bb with its lateral edge aligned to the alignment reference member 122 and with its trailing edge aligned to the trailing edge stopper B'. The aligning rod 25 penetrates through all the bins B, and therefore, the sheets S received by the other bins B are similarly aligned.

Now, it is possible that the sheets S discharged to and accommodated by the bins are stapled. If the stapling mode is not selected, the operation of the sorter 1 terminated here.

If the stapling mode is selected, the solenoid 156 is actuated by a stapling start signal, by which the electric stapler 45 is pulled by the solenoid 156 to rotate about a pivot 159 to the stapling position indicated by solid lines in FIG. 11. In this movement, the head 45*a* of the electric stapler 45 advances to the stapling position through an upper expanded space X formed between the bin Bb accommodating the sheets to be stapled and the upper adjacent bin Ba, whereas the anvil 45*b* is moved to the stapling position through the lower expanded portion X.

When the electric stapler 45 moves to the stapling position, the microswitch 161 is actuated to produce a permitting signal, in response to which the electric stapler 45 is actuated to staple the sheets S by a staple 162.

After this stapling operation, the solenoid 156 is deenergized so that the electric stapler 45 is returned to a position abutting to the stopper 160 by the stapler spring 157. This is the end of the stapling operation.

In the stapling operations for plural bins, it is most efficient to start the stapling operation with the last bin B which has received the last discharged sheet. The above-described series of operations start in response to a signal indicative of completion of the bin shifting operation; then, the next bin shifting operation starts in response to a signal indicative of completion of the series of operations of the electric stapler 45. By repeating those operations, the stapling operations are automatically performed for all the necessary bins. The number of bin shifting operation is equal to the number of the bin shifting operations during the sorting operation.

According to this embodiment, the bin frame 19 of the bin unit 9 is provided with the alignment reference member 122, and also, the bin unit 9 is provided with a sheet aligning unit including an aligning rod 25, and therefore, the sheets S on the bins B can be aligned with certainty. In addition, since the alignment of the sheet is effected by movement of the aligning rod 25 penetrated through openings 23 formed in all of the bins B, and since the aligning rod 25 is mounted on the bin unit 9, the sheets S can be aligned by the movement of the aligning rod 25 even during the bin shifting operation as well as immediately after the sheet is discharged on a bin B. In other words, the sheets S can be aligned at any time other than during the sheet S being in the process of discharge.

Furthermore, the aligning rod 25 is moved by rotation about the rotational shaft 129 in this embodiment, and the rotational shaft 129 and the alignment reference member 122 are integral with the bin unit 9, wherefore the sheets can be aligned always stably.

Since two expanded spaces X and X are formed opposed to the electric stapler 45, the head 45*a* and the anvil 45*b* of the electric stapler 45 are easily displaced to the respective stapling positions at the time of stapling operation, and in addition, the sheets can be stapled assuredly without interference with the sheets S accommodated on the lower bin B.

In this embodiment, the aligning rod 25 and the electric stapler 45 are swingable about respective pivots, but one or both of them may be rectilinearly moved.

A further embodiment of the present invention will be described, which is a partly modified embodiment from the above-described embodiment.

Figure 12:
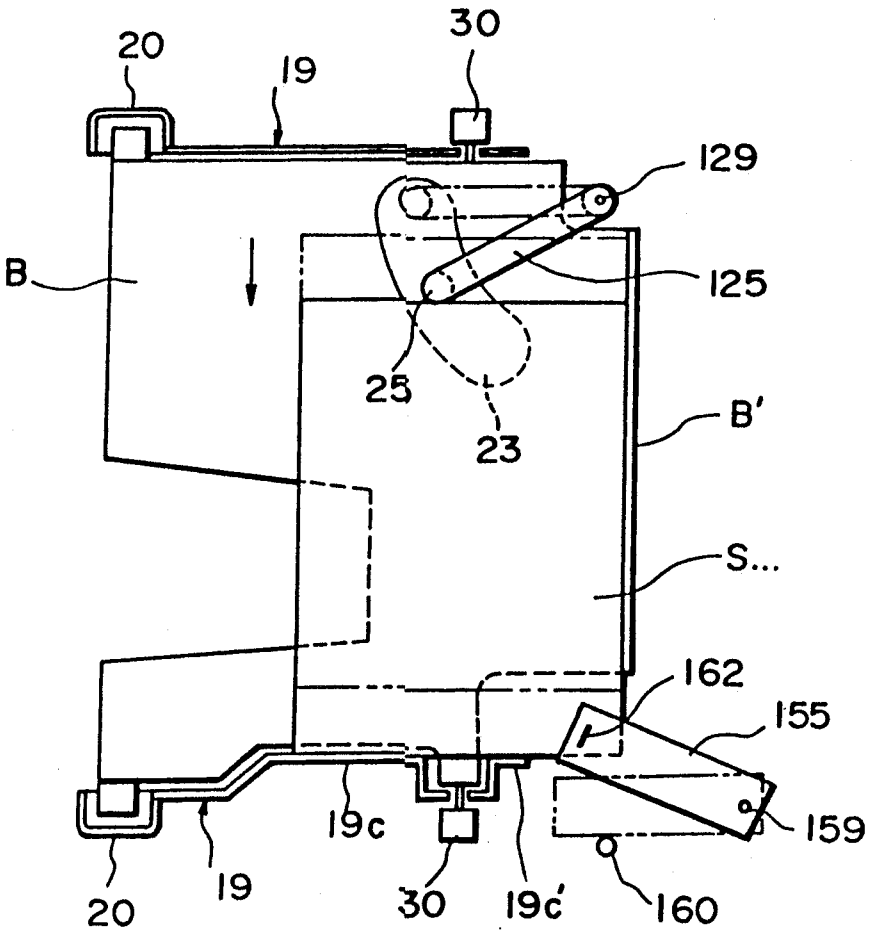
FIG. 12 is a top plan view illustrating an alignment reference in this embodiment.

As shown in FIG. 12 showing this embodiment, a part of front side of the bin frame 19 is formed into a sheet alignment reference 19*c*, in place of the alignment reference member 122 in the foregoing embodiment. Since the alignment reference 19*c* and the bin frame 19 are integral, the sheet alignment reference 19*c* can be extended to the neighborhood of the stapler 45, as will be understood by a reference 19*c*', so that the width of the sheet alignment reference 19*c* can be increased to make possible a more stabilized sheet aligning operation.

Figure 13:
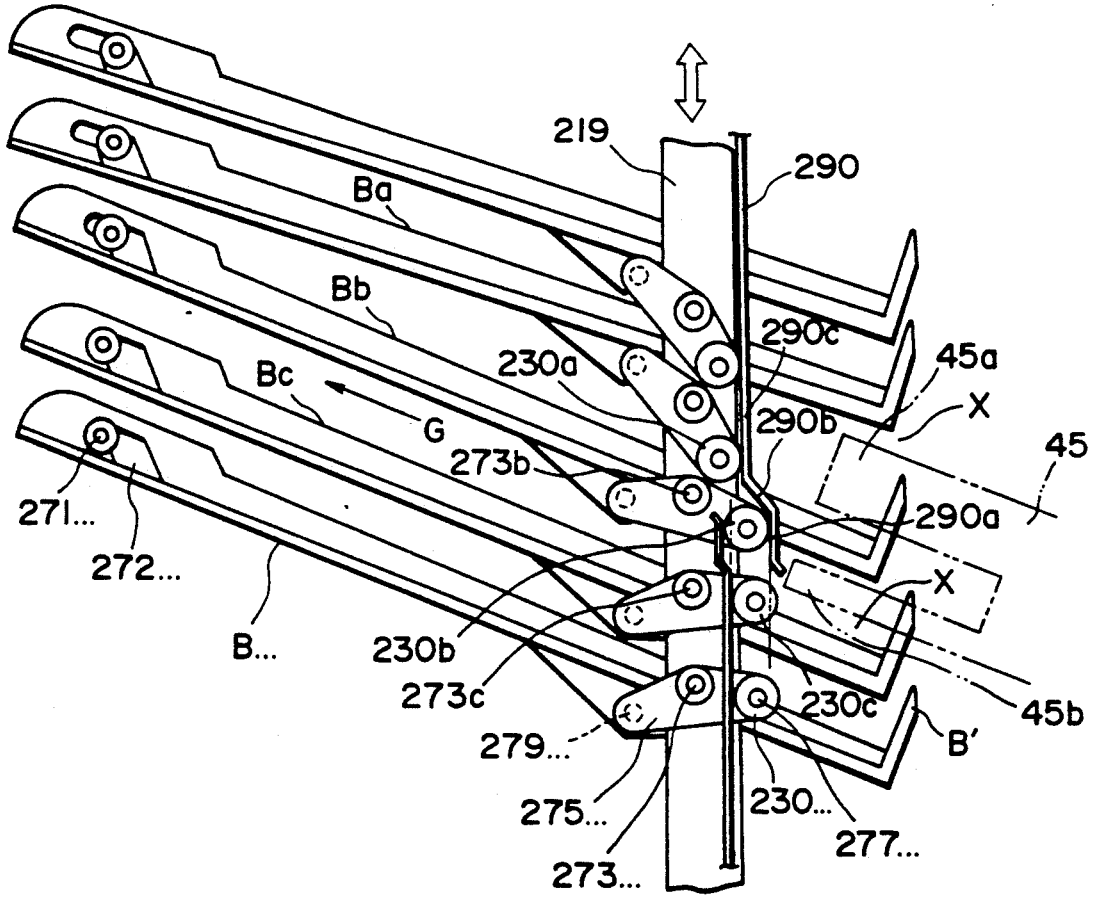
FIG. 13 is a side view of a sorter according to a further embodiment of the present invention, an example of illustrating expanding means.

Referring to FIG. 13, a further embodiment will be described, wherein the structure for providing the expanded portions or spaces X and X is different.

An elongated slot 272 is formed in each of the bins B which is slidably engaged with an end side shaft 271 fixed to the bin slider 20 of the bin unit 9. An arm lever 275 is rotatably mounted on each of base side shafts 273 securedly fixed to the bin frame 219. At one end of the arm lever 275, a trunnion 230 is rotatably mounted by a pin 277. At the other end of the arm lever 275, a pin 279 is mounted, which pin is engaged with a hole of the bin B. By this structure, the bin B is swingably supported on the arm lever 275. The bin B is inclined toward the base side (toward the trailing edge stopper B'), so that it moves downwardly by its weight.

A stationary cam plate 290 is fixedly mounted to each of the side plates of the sorter to guide the trunnions 230.

When the bin frame 219 moves upwardly, the trunnions 230 together with the bins B move upwardly while being in contact with the cam plate 290.

First, the trunnion 230*b* of the second bin Bb contacted to a first cam surface 290*a* of the cam plate 290 rotates downwardly about the pin 273*b*, so that the bin Bb moves substantially parallel to a direction indicated by a reference G to provide expanded space between the lower third bin Bc.

On the other hand, as to the first bin Ba above the second bin Bb, the trunnion 230*b* thereof moves along the tapered surface 290*b* of the cam plate 290 to be brought into contact with a second cam surface 290*c* thus forming an expanded space X with the lower second bin Bb. As a result, two expanded spaces are formed. When the bins B are moved downwardly, to spaces X and X are formed similarly.

Figure 14:
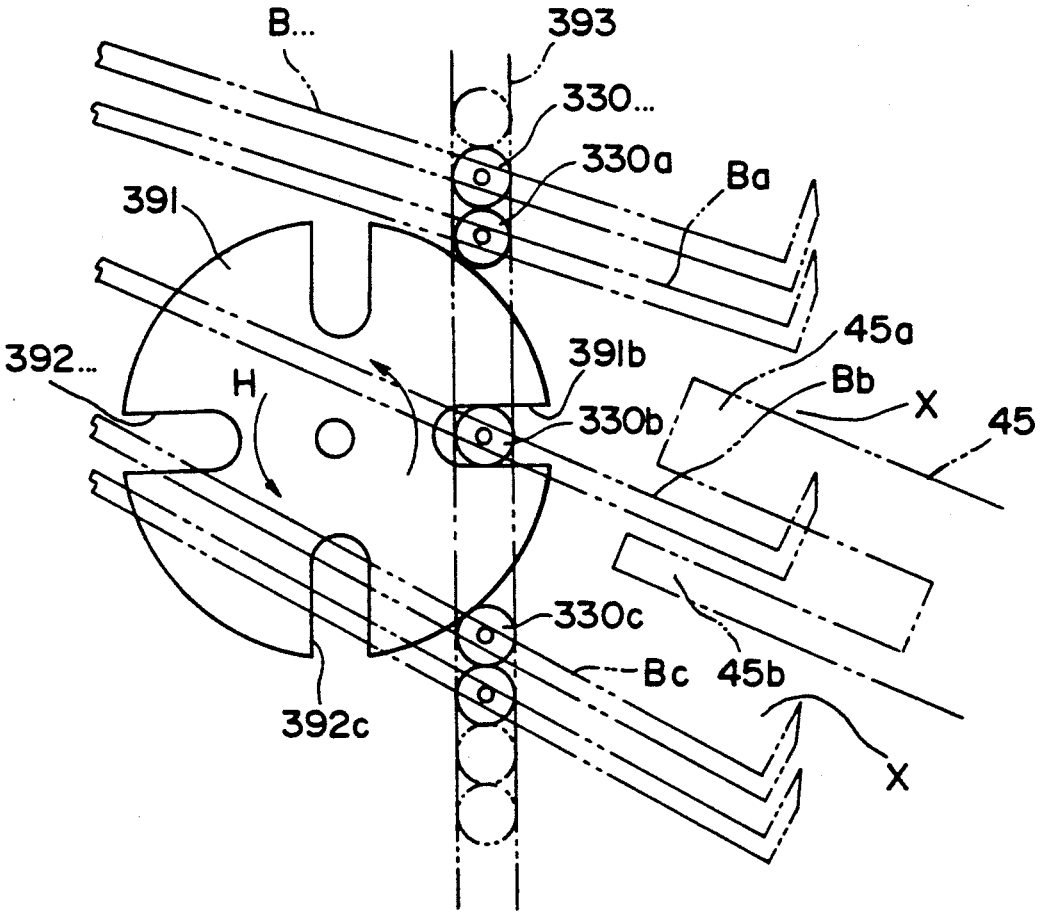
FIG. 14 is a side view of another example of expanding means according to a further embodiment of the present invention.
Figure 15:
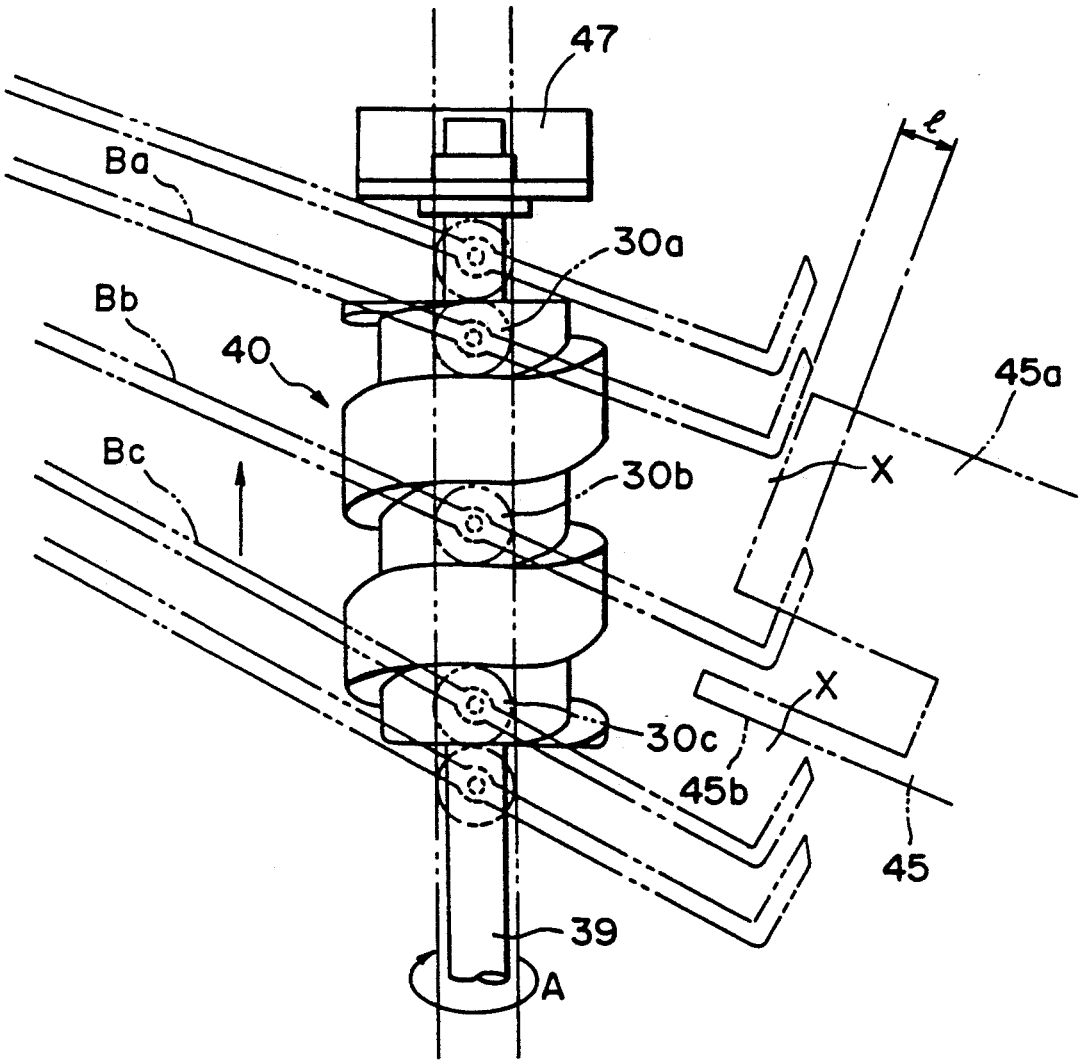
FIG. 15 is a side view of a lead cam according to a further embodiment of the present invention, illustrating deviation.

Referring to FIG. 14, another embodiment taking another form of the expanding structure.

In this embodiment, the use is made with a Geneva pulley 391 having slots 392 engageable with the trunnions 330 of the bins B to form two expanded spaces between bins, simultaneously.

The pulley 391 has four engaging slots 392 engageable with trunnions 330. When the pulley 391 rotates in the direction H, a trunnion 330 of a bin Bc, for example, is engaged with a slit 392*c* of the pulley 391, and it moves upwardly along the guiding slot 393 by the rotation of the pulley 391 to a position indicated by a reference 330*b*, where it is stopped. The trunnion 330*b* of the upper bin Bb placed at the position 330*b* is moved upwardly to the upper position 330*a*. In this manner, expanded spaces X and X are formed between the intermediate bin Bb and the upper bin Ba, and between the intermediate bin Bb and the lower bin Bc.

During the lowering movement of the bin B, two expanded spaces are formed.

The trunnions 330 are rotatably mounted to the respective bins B and are stacked in the guiding slot 393. The bottommost trunnion 30 is urged upwardly by the spring.

Referring to FIGS. 16–22, the description will be made as to the embodiments for the structures of the sheet alignment.

Figure 16:
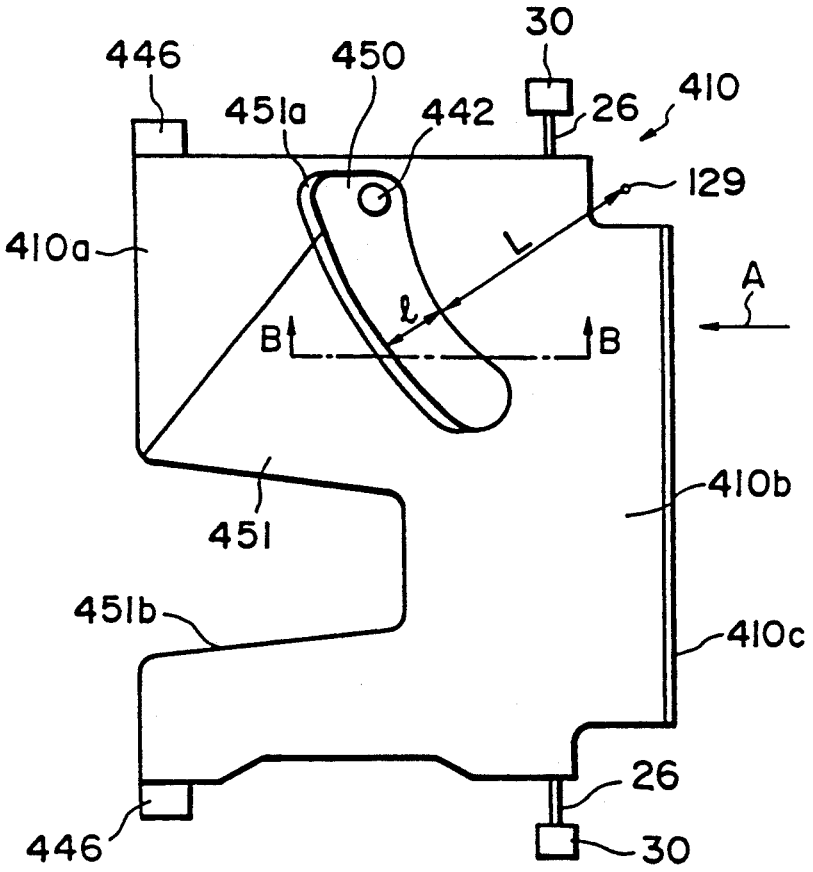
FIG. 16 is a top plan view of another example of a bin according to the present invention.
Figure 17:
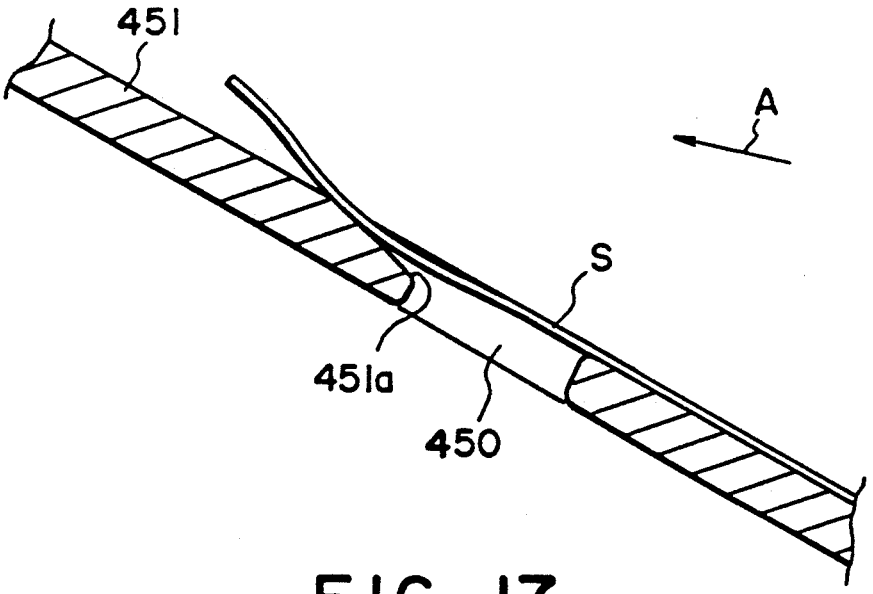
FIG. 17 is a sectional view taken along a line B—B of FIG. 16.

As shown in FIG. 16, the bin 410 is provided with engaging plates 446 at front and free end side and at the rear free end side, respectively. The engaging plate 446 engages an unshown supporting plate disposed inside the frame 20 to support the free end side of the bin 110. The bin 410 is further provided with supporting shafts 26 at the front base side and the rear base side thereof, respectively. Each of the supporting shaft 26 has a roller 30 rotatably mounted thereto. The bin 410 has an elongated slot 450 extending a predetermined distance (L) away from the shaft 129. The slot 450 has such a length as is longer than the rotational distance through which the alignment rod 125 is movable and has a width sufficiently larger than the diameter of the alignment rod 125 (minimum width is 1). The downstream surface of the slot 450 with respect to the sheet discharging direction A, is tapered 451*a* (FIG. 17). The corner portion 410*a* of the bin 410 at the free end and rear side is inclined at a predetermined angle with respect to a sheet supporting surface 410*b*. The base side 410*c* is extending perpendicularly to the sheet supporting surface 410*b*. The bin 410 itself is inclined upwardly toward the free end. By this inclination, the sheet is aligned in the sheet conveying direction by the sheet sliding on the sheet supporting surface 410*b* so that its trailing edge abuts the perpendicular portion 410*c*. A cut-away portion 451*b* is formed extending from the free end of the bin 451 generally to the center of the sheet supporting surface 410*b* to facilitate the operator to take out small size sheets stacked on the sheet supporting surface 410*b*.

Figure 18:
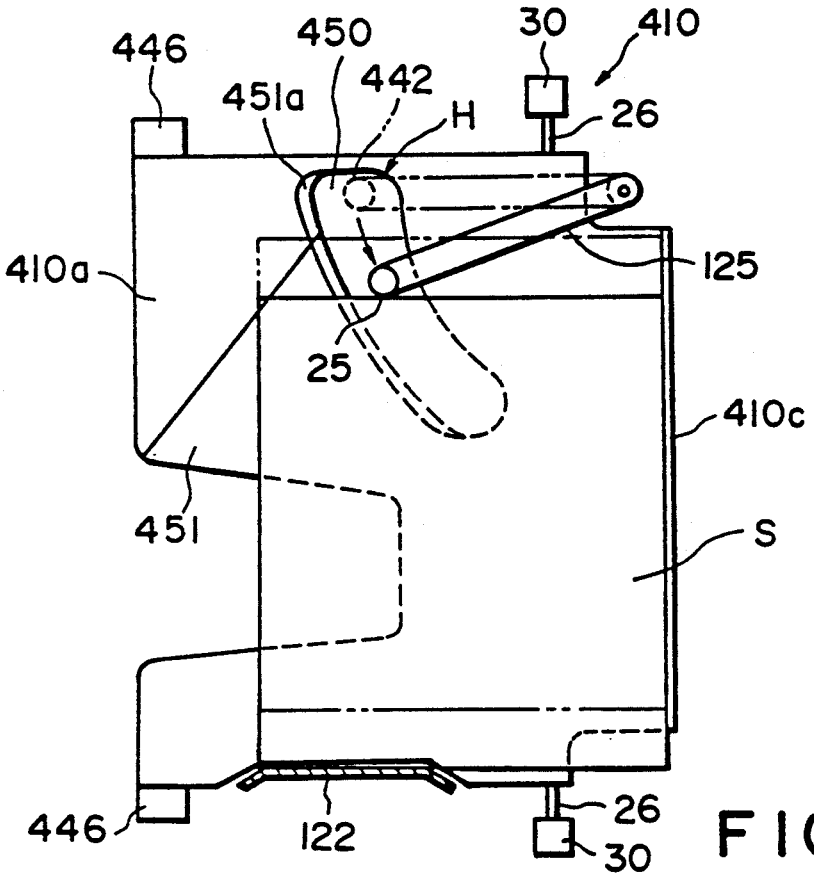
FIG. 18 is a top plan view of a bin illustrating a sheet aligning operation.
Figure 19:
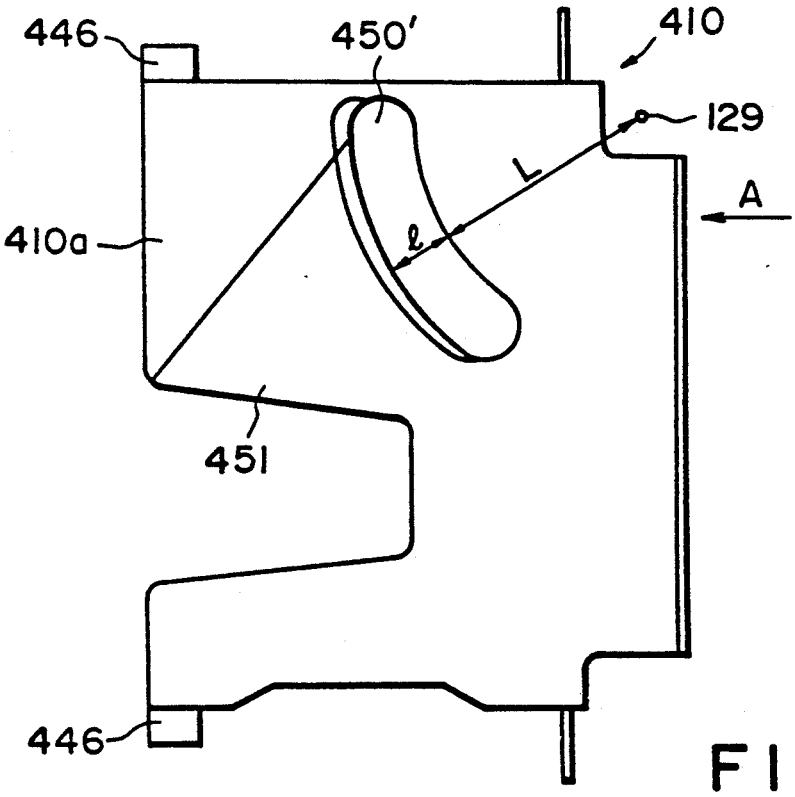
FIGS. 19–22 are top plan views of bins illustrating examples of a slot therein.
Figure 22:
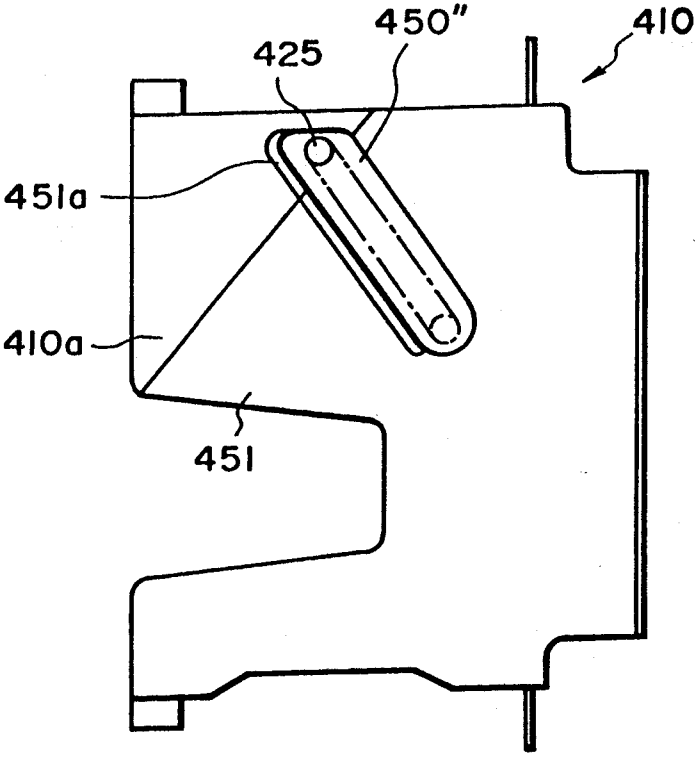

In operation, the sheet S discharged from an image forming apparatus after being subjected to an image forming operation is discharged to the topmost bin by the discharging roller couple 15 through the passage 12. At this time, the leading edge of the sheet S passes above the elongated slot 450, but the leading edge of the sheet S is not obstructed by the elongated slot 450 because it is guided by the taper 451*a* (FIG. 17) The sheet S discharged on the bin slides on the bin 151 to abut the base perpendicular portion 410*c* by the inclination of the bin. However, the sheet S is still away from the alignment reference plate 122, as shown by chain lines in FIG. 18. Then, the pulse motor 135 rotates through a rotational angle determined in accordance with information from the image forming apparatus indicative of the sheet size, so that the alignment rod 25 moves from the home position H in the direction indicated by an arrow in the elongated slot 450, thus moving the sheet S from the chain line position to the solid line position, whereby the sheet S is abutted to and aligned with the alignment reference plate 122 (FIG. 18). After a predetermined period of time, the pulse motor 135 is reversed to return the alignment rod 142 to the home position H. In the foregoing embodiment, the elongated slot 450 is formed at a predetermined distance (L) away from the shaft 129 (radius L) with a minimum width 1. Alternatively, as shown in FIG. 19, the slots 450′ may be formed by circumferences having a radius L and (L+1) about a shaft 129.

Figure 20:
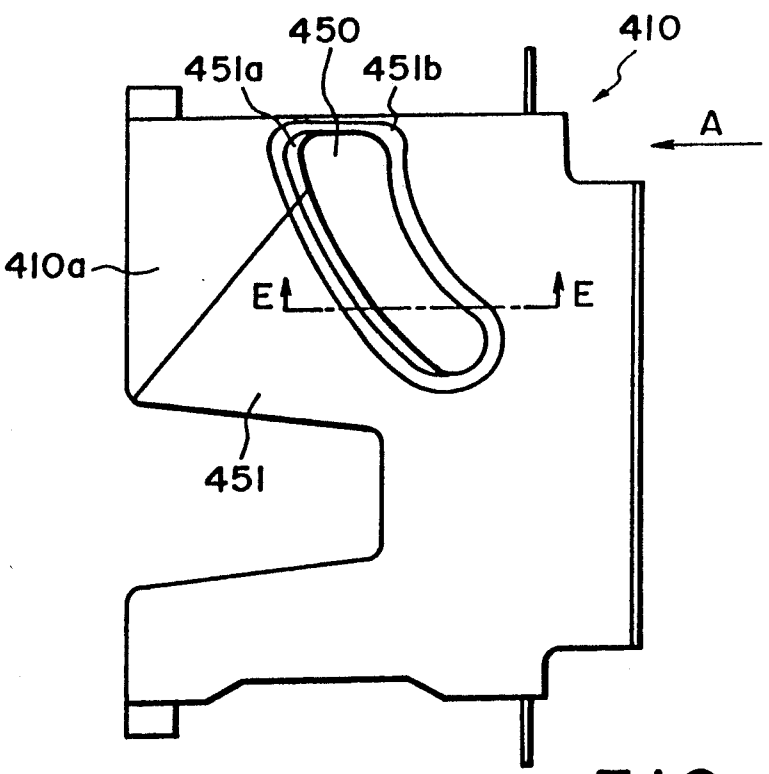
Figure 21:
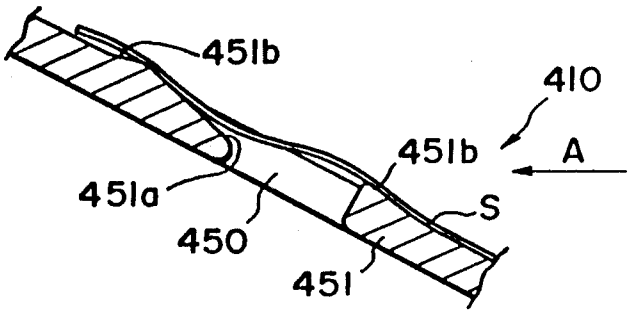

As shown in FIGS. 20 and 21, the portion around the periphery of the elongated slot 450 of the bin 451 may be made thicker with smooth inclination to form a thick portion 451*b*. By this, the bin 451 is reinforced, and the sheet S discharged onto the bin is guided upwardly by the thick portion 451*b* to prevent the sheet S from being obstructed by the elongated slot 450.

Figure 23:
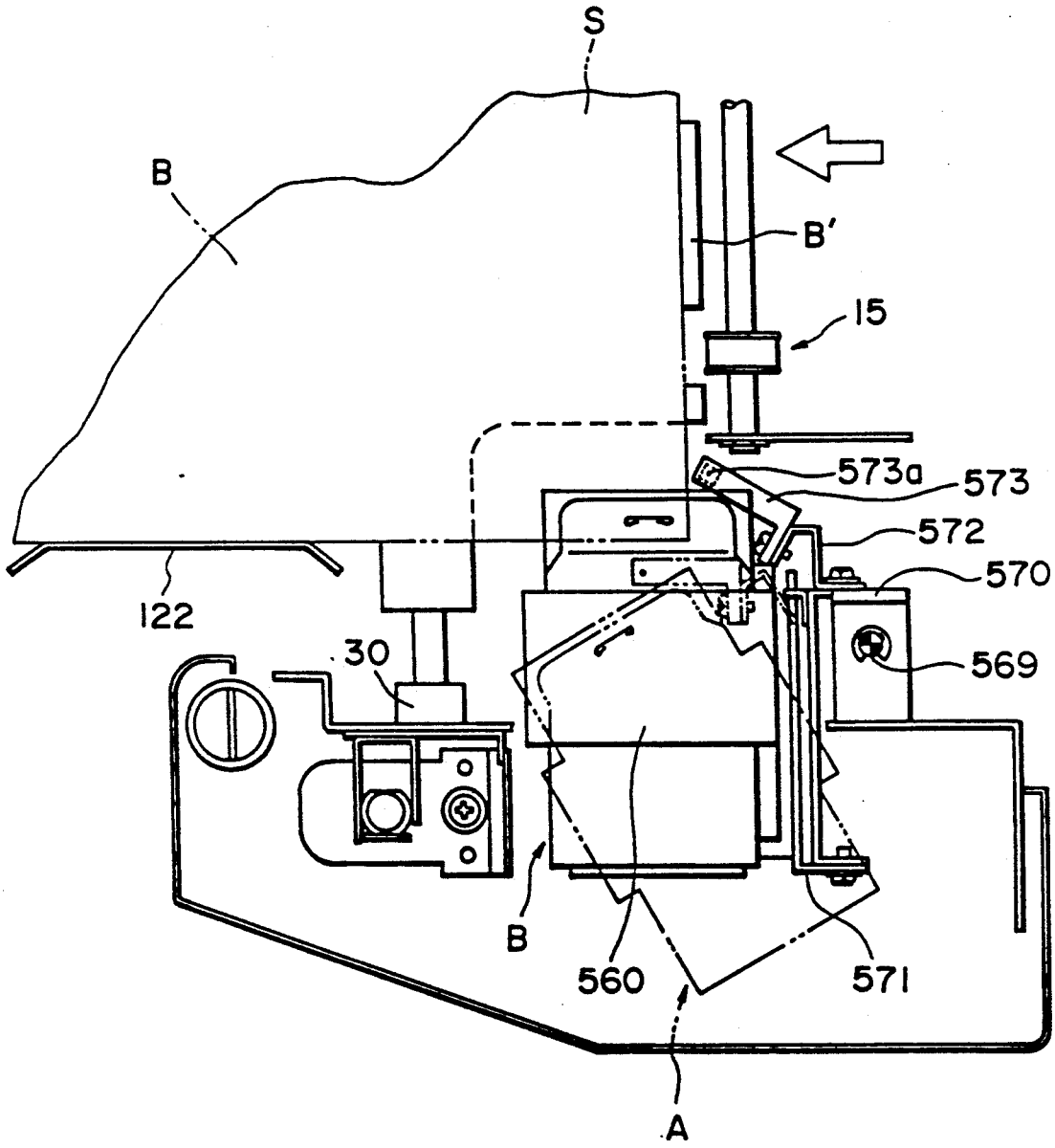
FIG. 23 is a top plan view of a sorter according to a further embodiment of the present invention wherein a sheet detecting means is illustrated.

In the foregoing embodiment, the alignment rod 25 is rotated, but as shown in FIG. 23, it (aligning rod 425) may be made movable along a rectilinear line. In that case, the elongated slot 450″ is extended straight, by which the contact portion between the elongated slot 450″ and the sheet S is reduced, therefore, the obstruction by the slot 450″ to the sheet movement S is further prevented.

As described, according to this embodiment, the bin is provided with the elongated slot for allowing penetration of alignment member, so that the alignment member moves through the slot to perform the sheet aligning operation, by which the necessity of the provision of an open slot for allowing insertion of the alignment member is eliminated, so that the strength of the bin can be assured. In addition, the possibility that the sheet is obstructed by the slot resulting in inability of the alignment can be reduced.

Also, since only one corner portion 410*a* at the downstream free end side of the bin with respect to the sheet discharging direction where the alignment member 442,450 is located, is inclined with respect to the sheet supporting surface 410*b*, the sheet aligning operation by the aligning member 442 can be performed without obstruction. More particularly, even if there is a cut-away portion 451*b* for allowing small size sheets to be taken out, the inclined surface 410*a* is effective to keep the sheets with a certain degree of rigidity when large size sheets are supported on the sheet supporting surface 410*b* to prevent the sheets to be flexed; and despite the fact, the inclined portion is not formed at the alignment reference plate 121 side.

By providing tapered surface 451*a* at the downstream side of the elongated slot 450 with respect to the sheet discharging direction, the sheet is prevented from being obstructed by the elongated slot 450 when it is being discharged, so that the sheet can be assuredly received on the bin 451.

By forming a thick portion 451*b* around the periphery of the elongated slot 450, the strength of the bin about the elongated slot 450 can be increased.

Referring to FIGS. 23–28, the stapler according to other embodiment will be described in detail.

Figure 24:
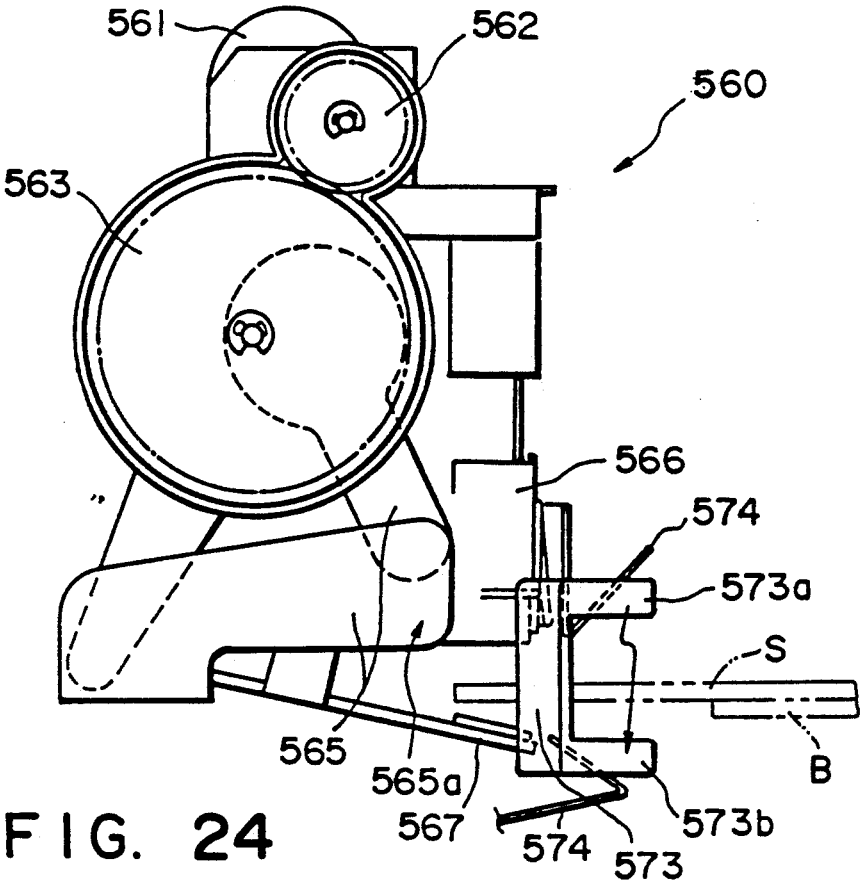
FIG. 24 is a side view of the apparatus of FIG. 23.
Figure 25:
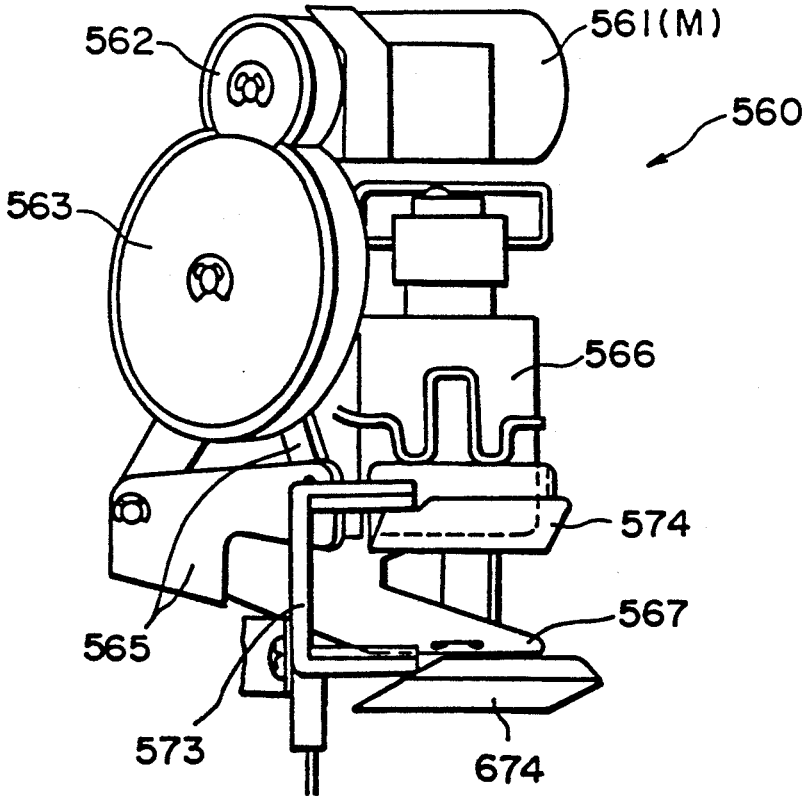
FIG. 25 is a perspective view of the apparatus of FIG. 23.
Figure 26:
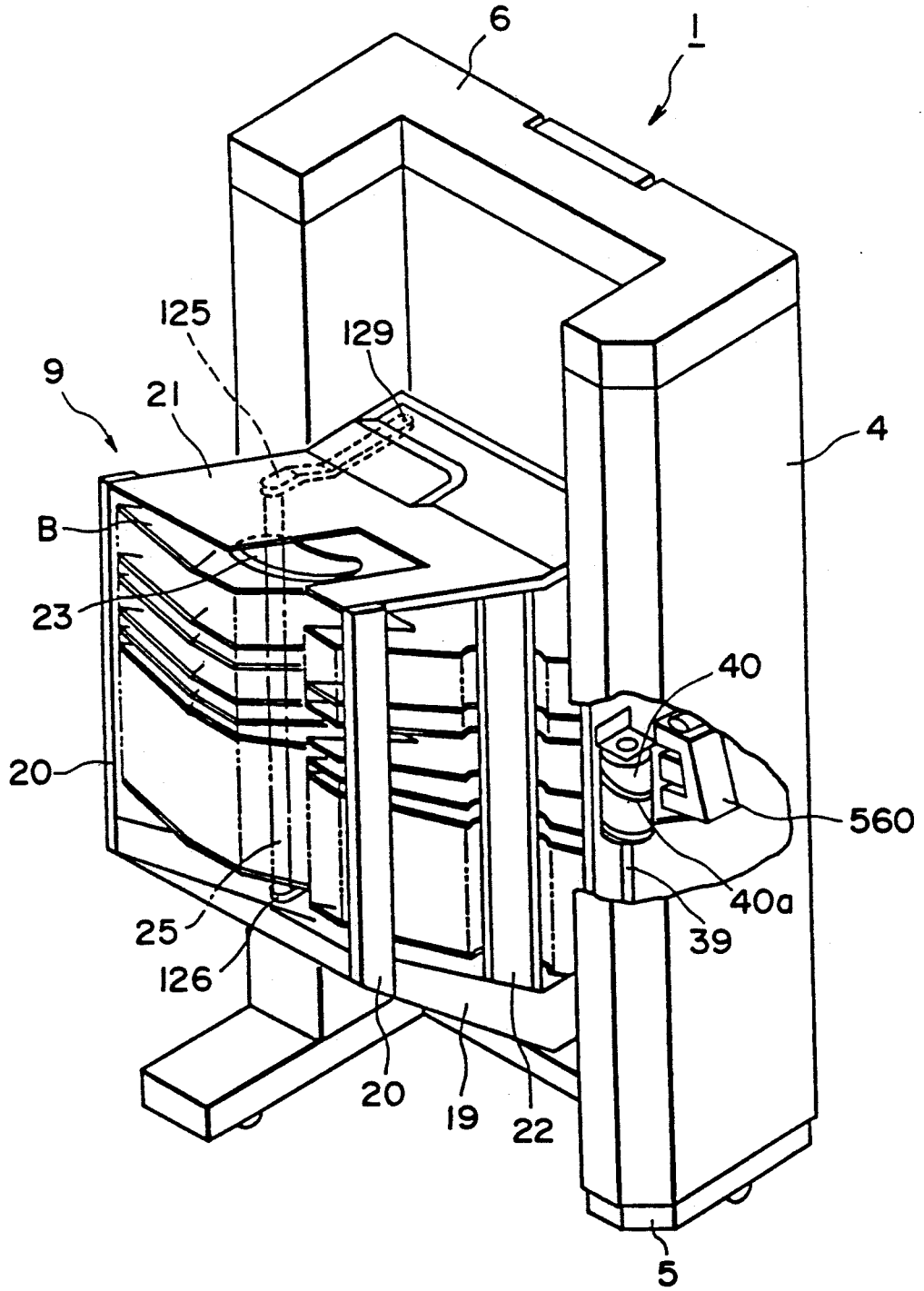
FIG. 26 is a perspective view of post processor provided with a stapler shown in FIGS. 23-25.
Figure 27:
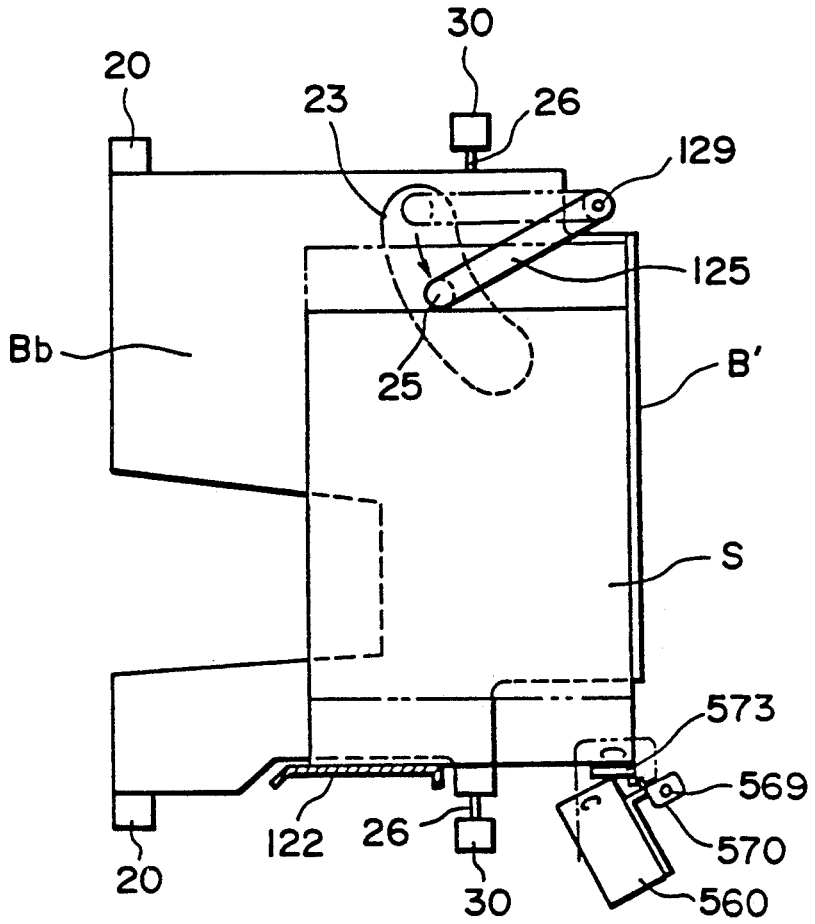
FIG. 27 is a top plan view of the apparatus according to a further embodiment of the present invention.

As shown in FIGS. 23, 24 and 25, the stapler 560 includes a driving motor 561, a gear 562 fixed to an output shaft of the motor 561, wherein a gear 563 is meshed with the gear 562. The gear 563 is connected with a link 565 having an end mounted to the frame of the apparatus. At an articulation 565*a* of the link 565, a stapling head 566 is disposed. Below the stapling head 566, an anvil 567 is disposed. The stapler 560 is fixedly mounted on a stapler base 561 fixed on a swingable base 570 which is swingable about a shaft 569, so that it is movable swingingly together with the swingable base 570. The swingable base 570 is provided through the mounting base 572 with a sheet detecting sensor 573 for detecting presence and absence of the sheet adjacent a front and right corner of the stapler 560. The sensor block 573 comprises a light emitting portion 573*a* and a light receiving portion 573*b* and is in the form of a channel.

In operation, the swingable base 570 is rotated by an unshown motor to move the stapler 560 from a normal retracted position A to the stapling position B by the rotation about the shaft 569. During this motion, the trailing and front corner of the sheet S on the bin B relatively passes across the space between the light emitting portion 573*a* and the light receiving portion 573*b* of the sheet sensor 573 which swings together with the swinging motion of the swingable base 570, by which the sheet S is detected by the sensor block 573. If the sheets S on the bin B have in advertently taken out so that the sensor block 573 does not detect any sheet, the microcomputer 561 prevents the stapling action by the stapler 560 and returns it to the retracted position A. When the microcomputer receives a signal indicative of the presence of the sheet S by the sensor block 573, it drives the motor 561 to allow the stapler 560 to staple the sheets S on the bin B. After the stapling action, the stapler 560 is returned to its retracted position A. The microcomputer rotates the lead cam 40 by the driving motor 42 to lift the bins through one stage, and after the sheet sensor block 573 detects the presence of the sheet S accommodated on the second bin B, the stapler 560 now disposed for the second bin performs the stapling action. By the similar operations, the bins B are lifted step by step, and sets of the sheets S on the bins B are sequentially detected by the sheet sensor block 573, and is stapled. When all of the sets of the sheets S on the bin B are stapled, the stapling operation is stopped.

In the foregoing embodiment, the stapling operation was performed after completion of the sorting and accommodation of the sheets S, but it is a possible alternative that a set of sheets S is stapled each time the final sheet S is discharged on the bin.

Figure 28A:
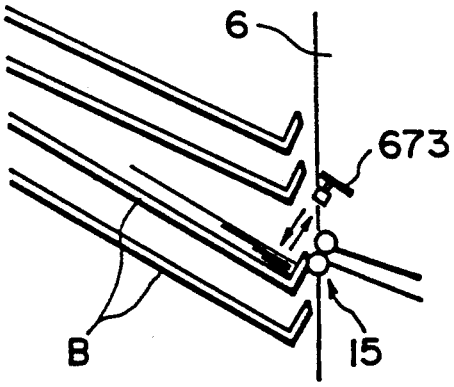
FIG. 28A and 28B are side views illustrating sheet detecting means according to a further embodiment of the present invention.
Figure 28B:
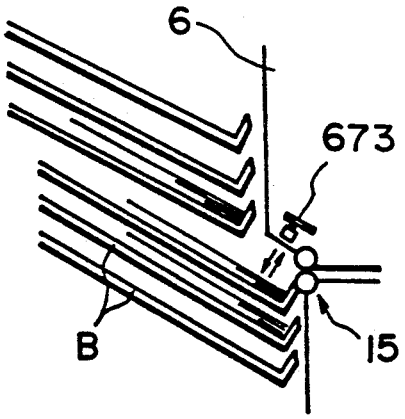

In the foregoing embodiment, a transparent type sensor movable together with the stapler 560 is used for the sheet detecting sensor block 573, but it is a possible alternative that a reflecting type sensor fixedly mounted to the frame 6 may be used, as shown in FIG. 28A. If this is used, mounting of the sensor 673 is easy if the sorter 1 is of the type wherein the bins 110 are movable horizontally (sheet discharging direction), as shown in FIG. 28B.

In the foregoing embodiment, the sheet sensor 673 is movable integrally with the stapler 560, but the sensor 673 may be independently rotatable.

In the foregoing embodiment, the sheet sensor block 573 is mounted to the swingable base 570 through the mounting base 572, but the light emitting portion 573*a* and the light receiving portion 573*b* of the sheet sensor 573 may be mounted to the head 566 and the anvil 567 of the stapler, respectively.

As described in the foregoing, according to this embodiment, there is provided detecting means for detecting the sheets accommodated on the bin on which the stapler acts, and the stapling operation is allowed only when the detecting means detects the sheet on the bin, and therefore, the stapler is prevented from performing the stapling action without sheets, which can result in jam of staples.

By mounting the detecting means on the stapling device, it is possible to detect presence or absence of the sheets to be stapled during the stapler moving to the stapling position, whereby particular time is not required for the detection. Therefore, the post processing operation can be speedily and efficiently performed.

Referring to FIGS. 29–33, another embodiment will be described by which the sheets which have been curled at their leading edges can suitably be stapled.

Figure 29:
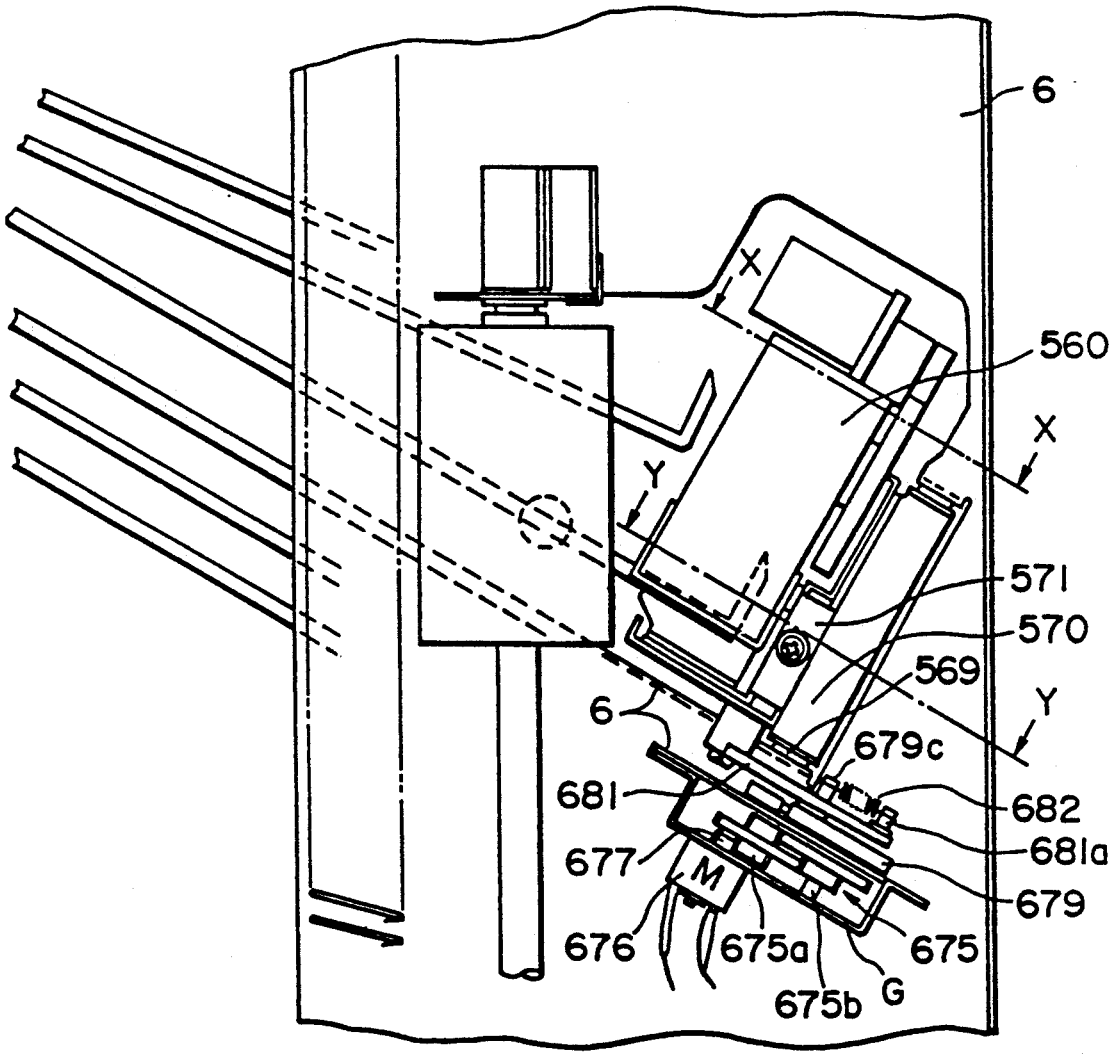
FIG. 29 is a side view of a post processor particularly illustrating details of a mechanism for moving the stapler.
Figure 30:
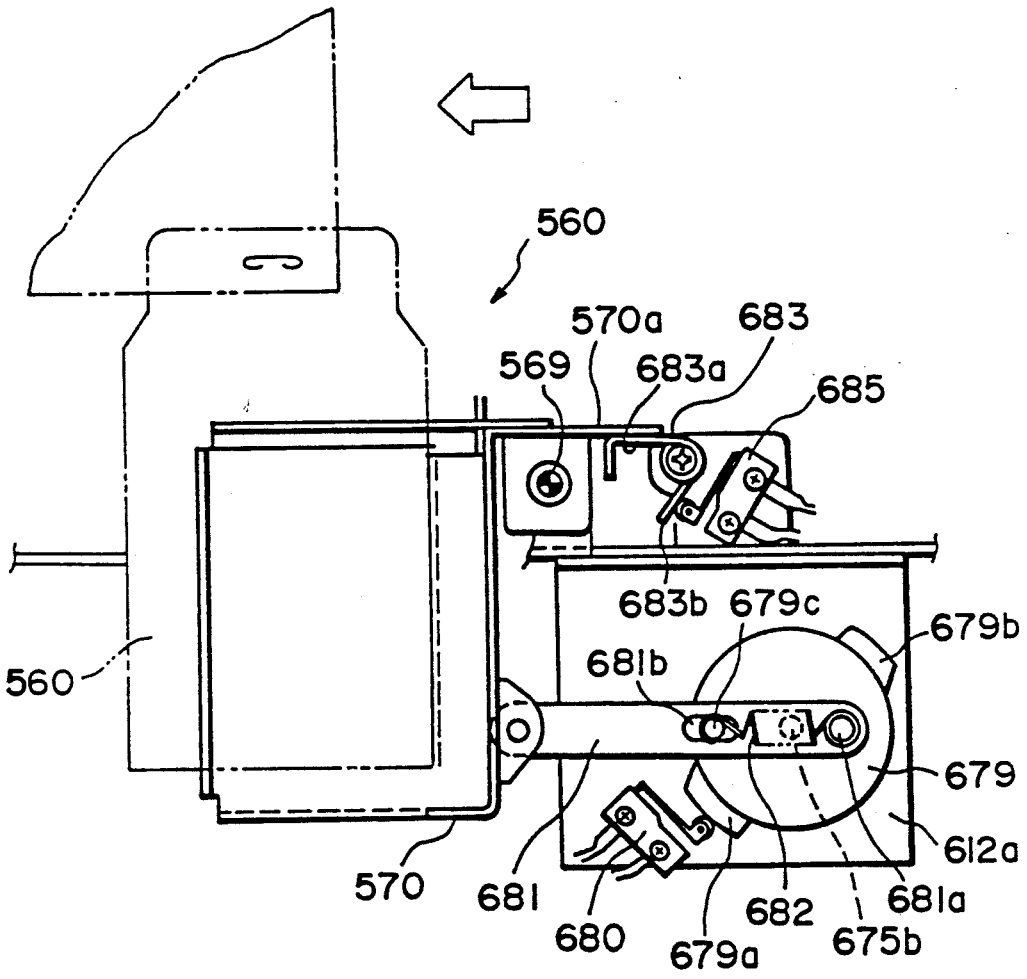
FIG. 30 is a sectional view taken along a line Y—Y of FIG. 29.

As shown in FIGS. 29 and 30, the frame 6*a* has a shaft 569 mounted thereon, on which a swingable base 570 is rotatably supported. The swingable base 570 has a stapler base 571 fixedly mounted thereto. The stapler base 571 carried a stapler 560. To the frame 6*a*, a gear box G containing reduction gears 675 is mounted, and to the gear box G a motor 676 is mounted. The motor 676 has an output shaft to which a gear 677 is fixedly mounted. The gear 677 is meshed with an input gear 675*a* of the gear train 675. The gear train 675 has an output shaft 675*b* to which a link disk 679 is mounted. To the outer periphery of the link disk 679, cams 679*a* and 679*b* are disposed, and they serve to actuate or deactuate a microswitch 680 which is mounted on the frame 6*a* to energize the motor 676. Adjacent the outer periphery of the disk 679, a shaft 679*c* is mounted. To the swingable base 570, a link arm 681 is connected for rotation in a horizontal plane. The link arm 681 is provided with a shaft 681 and has an elongated slot 681*b*. Through the slot 681*b*, the shaft 679*c* is penetrated, and a spring 682 is stretched between the shaft 379*c* and the shaft 681*a*. In the neighborhood of the shaft 569, a bell crank arm 683 made of resin material or the like is rotatably supported. An end 683*a* of the arm 683 is contacted to an end 570*a* of the swingable base 570, and the other end 683*b* is contactable to a microswitch 685 for detecting the stapler being displaced at its stapling position. To the swingable base 570, a sheet sensor block 573 for detecting presence and absence of the sheet is mounted through a mounting base 572 (FIG. 23). The sensor block 573 comprises a transparent type sensor having a channel shape and comprising a light emitting portion 573*a* and a light receiving portion 573*b*.

In operation, when a preset numbers of stacks of the sheets S after being printed are sorted and accommodated on the respective bins, the microcomputer drives the driving motor 42 to rotate the lead cam 40 to place the topmost bin to the stapling position, that is, the position for receiving a sheet S discharged by the discharging roller couple 15. Then, the computer instructs the motor 376 to rotate, and the rotation of the motor 676 is reduced by the gear train 675 and is transmitted to the output shaft 675*b*. By this, the link disk 679 rotates in the clockwise direction. When the stapler 560 is at its retracted position A (FIG. 23), the cam portion 679*b* is in contact with the microswitch 680 to close it. However, by the clockwise rotation of the disk 679, the portion 679*b* is brought out of contact with the switch 680 to open it. Further, the clockwise rotation of the link disk 679 is transmitted to the link arm 681 from the shaft 679*c* to the spring 682 and the shaft 681*a*. Then, the arm 681 swings about a shaft 679*c* inserted in the slot 681*b* in the leftward direction (FIG. 30). By the movement of the link arm 681, the swingable base 570 swings about the shaft 569. When the link disk 679 further rotates, the cam portion 679*a* is brought into contact with the microswitch 680 to close it. The microcomputer receives the on-signal from the switch 680 and deenergizes the motor 676 to stop the link disk 679. At this time, the swingable base 570 is at a position shown in FIG. 30. An end 570*a* of the base 570 (FIG. 30) pushes an end 683*a* of the arm 683 to rotate the arm 683 in the counterclockwise direction. By this, the other end 683*b* of the arm 683 presses the microswitch 385 to actuate the switch 685. The microcomputer receives the on-signal of the switch 685 to detect the stapler 560 having moved to the stapling position B (FIG. 30). When the stapler 560 moves from the retracted position A to the stapling position B, the sheets S accommodated on the bin are guided by upper and lower guides 574 and 674 into the space between the head 566 of the stapler 560 and the anvil 567.

If the sheet S on the bin is curled, the curl of the sheet S is confined by the upper and lower guides 574 and 674, and the sheet is guided into the space between the head 566 and the anvil 567. During this, the set of sheets S is detected by the sensor block 573 by the trailing end front corner of the sheets S on the bin 110 passing through the space between the light emitting portion 573 and the light receiving portion **573*b* of the sheet sensor block 573 which integrally moving with the swingable base 570. If the sensor block 573 does not detect the sheets S for the reason, for example, that the sheets S have been inadvertently taken out from the bin by the operator, the microcomputer does not allow the stapler 560 to operate but causes it to be returned to the retracted position A. When the microcomputer 561 receives the signal indicative of the presence of the sheet S by the sensor block 573, it instructs to drive the driving motor 661 to make the stapler 560 staple the sheets S on the bin. After the stapling operation, the stapler 560** is returned to the retracted position A.

Figure 31A:
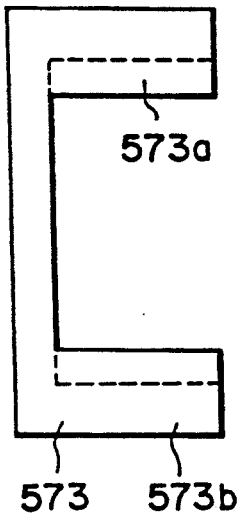
FIGS. 31A, 31B, 32 and 33 illustrate other examples of a mechanism for confining curling of the sheet.
Figure 31B:
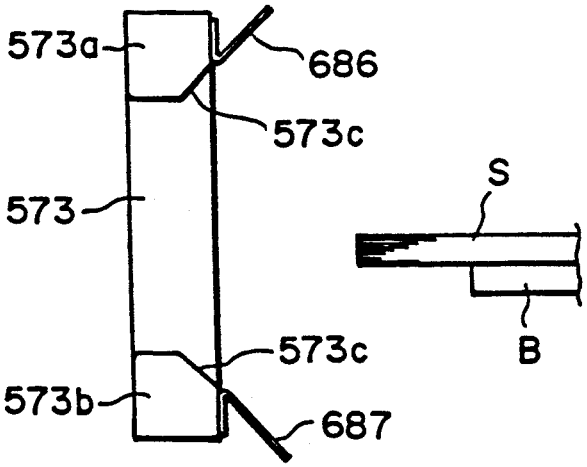

In the foregoing embodiment, the sheet sensor block 573 is in the form of a channel and has generally a rectangular cross section. It is a possible alternative that, as shown in FIGS. 31A and 31B, a tapered surface **573*c* is formed, wherein an upper guide 686 is provided on the same surface as the aforementioned upper guide 674, and a lower guide 687 is provided on the same surface as the aforementioned lower guide 674. By this, when the sheet accommodated on the bin is curled, the curl can be confined by the upper and lower guide 686 and 687 to prevent the sheet detecting sensor 573 from contacting the curled sheet S and folding it. By making the distance between the light emitting portion 573 and the light receiving portion 573*b* of the sensor block 573 sufficiently larger than the distance between the upper and lower guide 574 and 674, the sensor block 573** can be effectively prevented from contacting the sheet S.

Figure 32:
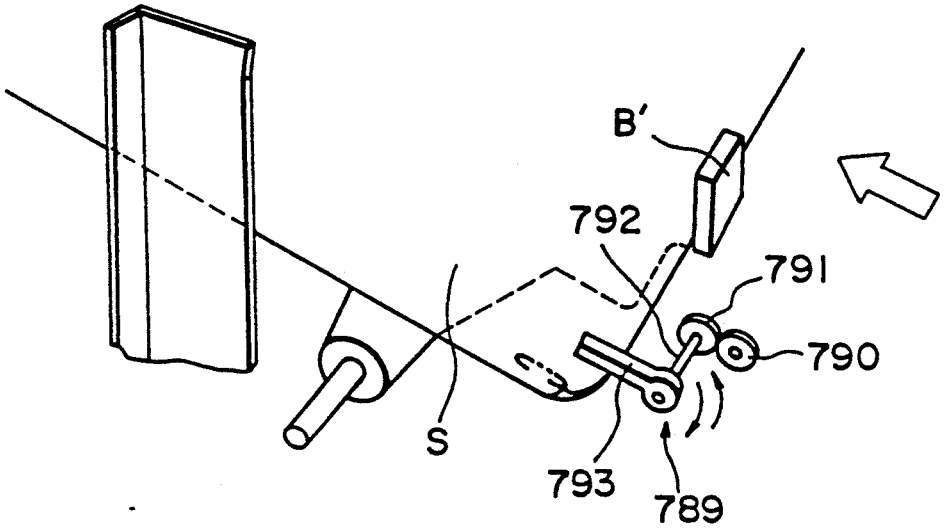

In the foregoing embodiment, the description has been made as to the case where the upper and lower guides 574 and 674 are employed as a means for confining the curled sheet. However, it is a possible alternative that, as shown in FIG. 32, a curled sheet confining member 789 is employed which is insertable and retractable with respect to the bin unit.

The curled sheet confining member 789 includes a gear 790 connected to an unshown motor, a gear 791 meshed with the gear 790 and a curled sheet confining rod 793 fixed to a shaft 792 of the gear 791. The rod 793 swings to confine the curled sheet.

Figure 33:
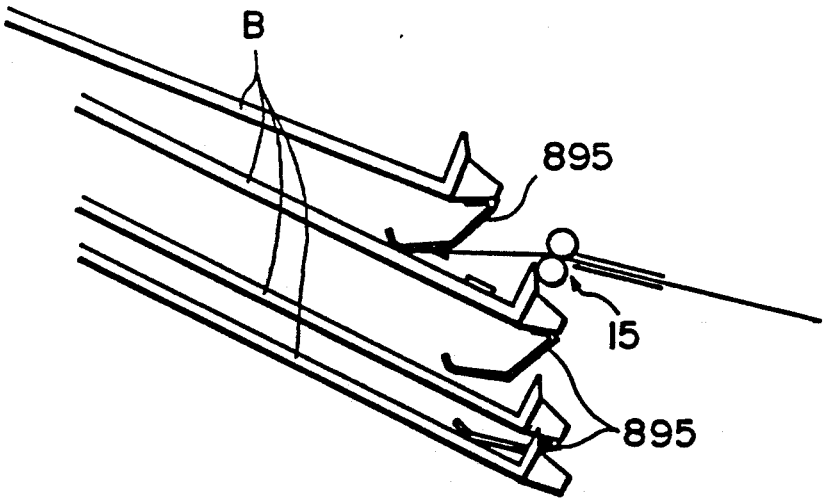

In this embodiment, the upper and lower guides 574 and 674 are used for confining the curled sheet. It is a possible alternative that, as shown in FIG. 33, a sheet confining spring 895 constituted by a leaf spring or the like is provided at a base side of each of the bins B. The curled sheet is confined by the confining spring 895 mounted to the adjacent upper bin B.

As described in the foregoing, according to this embodiment, there is provided a curl confining means to confine the curled sheet which is going to be stapled by the stapler, by which the sheet is prevented from being contacted by the stapler and being folded or being disturbed, which can result in improper stapling.

Referring to FIGS. 34, 35, 36 and 37, a mechanism for positioning the stapling device will be described.

At the front side of the sorter 6, there is provided an automatic (electric) stapler 955 for stapling the sheets accommodated in each of the bins B, facing a lower couple of discharging rollers 15. The automatic stapler 955 includes a solenoid 956 and a stapling spring 957.

The solenoid 956 has a link **956*a* to which a link pin 971 is fixedly mounted, and a solenoid spring 973 is stretched between the link pin 971 and a stapler pin 972 of the automatic stapler 955. The link 956*a* is engaged with the stapler pin 972 through a slot formed in an end portion of the link 956*a*. To the automatic stapler 955, a stapling position stopper 976 is fixedly mounted, and the stapler 955 is normally placed outside the path for the sheet (solid line position) by being contacted to the stopper 906 by the function of the stapler spring 957. When the sheets S on the bin B are stapled, the solenoid 956 is operated to move the stapler to the position shown by chain lines where the stapling position stopper 976 is abutted to a sheet alignment reference 919*c* of the bin frame 919. Then, the sheets S accommodated in the bin B opposed to the lower couple of the discharging rollers 15**.

Figure 34:
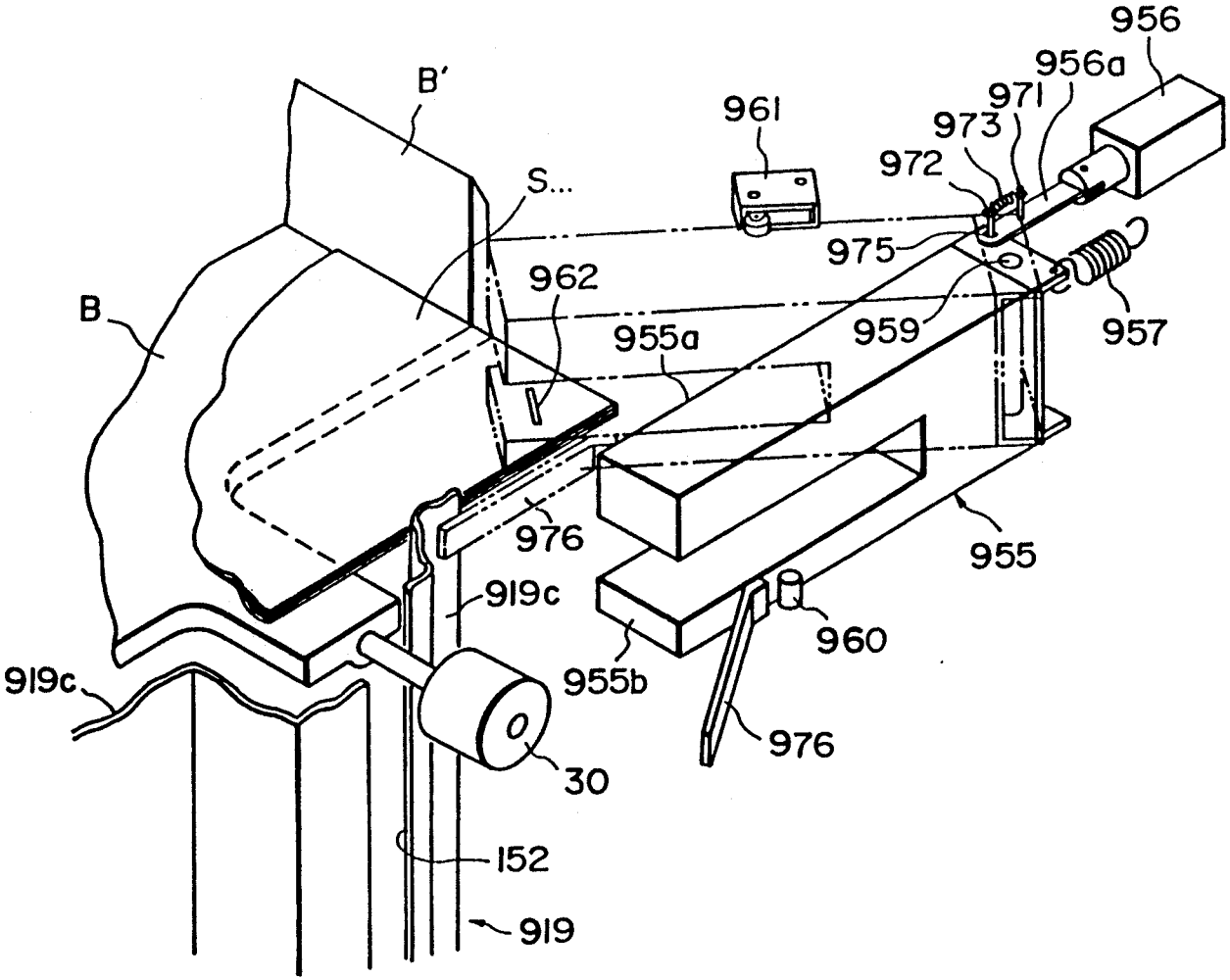
FIG. 34 is a perspective view of an apparatus according to a further embodiment of the present invention wherein a reference for positioning the sheet and the automatic stapler are shown.

In FIG. 34, indicated by a reference numeral 961 is a microswitch to detect the stapler 955 placed at the stapling position to produce a detection signal.

When a stapling mode is selected, the solenoid 956 is actuated in response to a stapling start signal.

The automatic stapler 955 rotatingly moves about a pivot 959 by the solenoid 956 and is moved to its stapling position so that the stapling position stopper 976 is abutted to the sheet alignment reference position **919*c*, by which the stapler 955** is correctly positioned.

Figure 35:
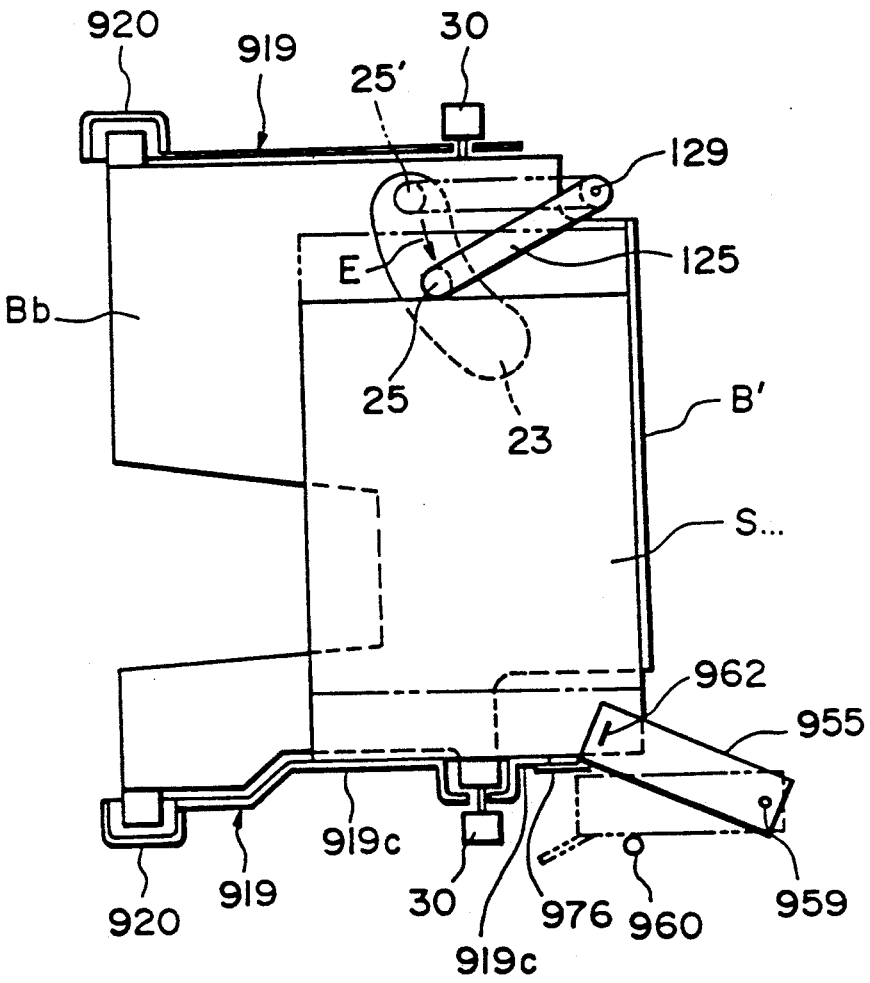
FIG. 35 is a plan view of the apparatus illustrating sheet alignment and stapler positioning.

At this time, the head portion **955*a* of the stapler 955, as shown in FIG. 35, for example, moves to the stapling position through an upper opening portion X formed between the bin Bb accommodating the sheets to be stapled and the adjacent upper bin Ba, and the anvil portion 955*b*** is moved to the stapling position through a lower opening X, that is the opening formed between the bin Bb and the adjacent lower bin.

As shown in FIG. 34, when the automatic stapler 955 is positioned at the stapling position, the microswitch 961 is actuated, so that a stapling permitting signal is produced, in response to which the stapler 955 is driven, by which the sheets S are stapled by staple 962.

After completion of the stapling operation, solenoid 956 is deactuated, and the stapler 955 is returned by the function of the stapler spring 957 to be contacted to the stopper 960. Thus, the stapling operation for one bin terminates.

When the stapling operations are carried out for plural bins B, it is most efficient if the stapling operation starts from the last bin B to which the sheet is lastly discharged. To do this, after the series of the stapler 955 operation in response to a signal indicative of completion of the bin shiftings, the bin is shifted in response to a signal indicative of completion of the series of the stapler 955 operations; and these are repeated until the stapling operation is effected for each of the bins. The number of the bin shifts for the automatic stapling, corresponds to the number of bin shifts at the time of the sorting operation.

Figure 36:
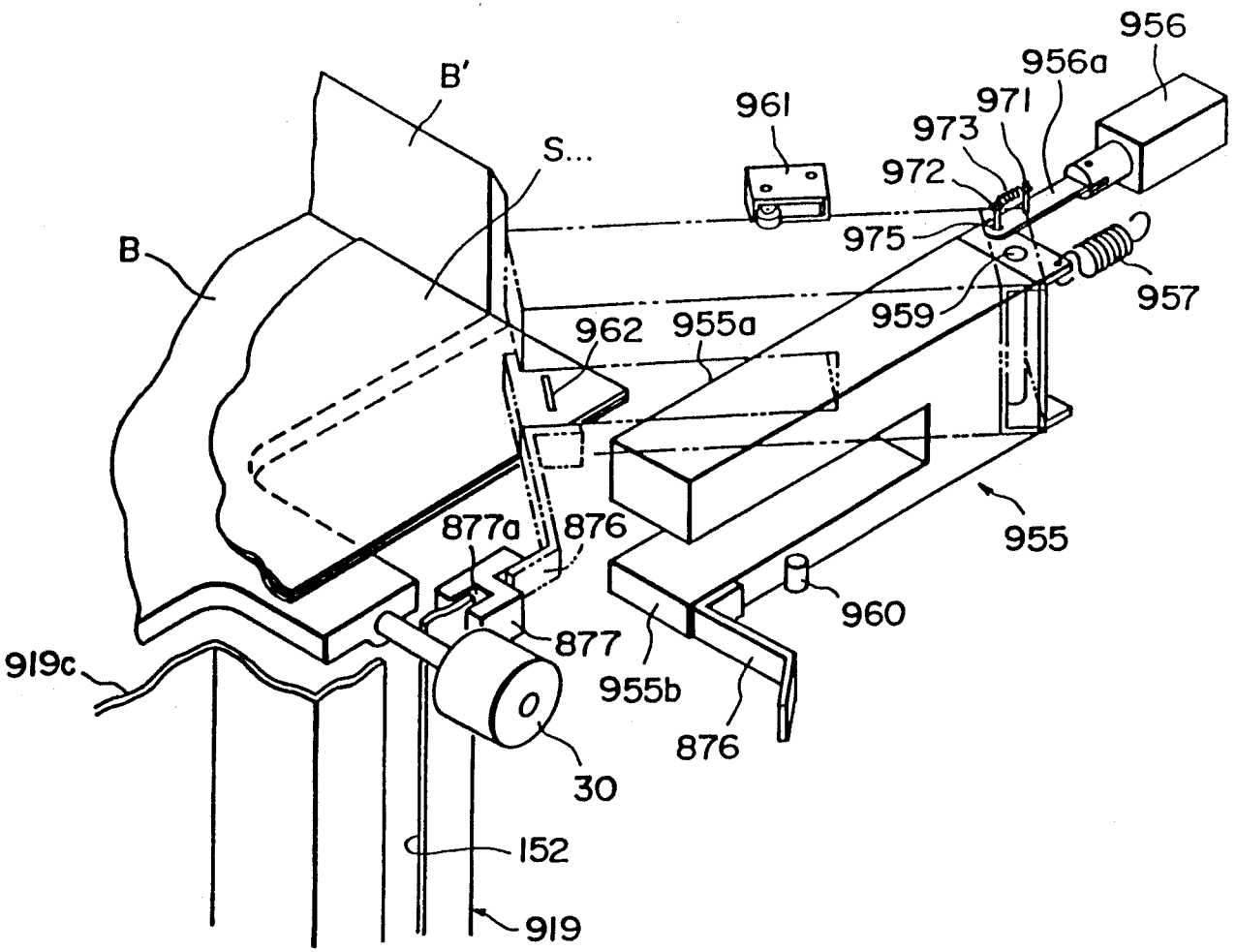
FIG. 36 is a perspective view of the apparatus illustrating a frame guide and an automatic stapler.
Figure 37:
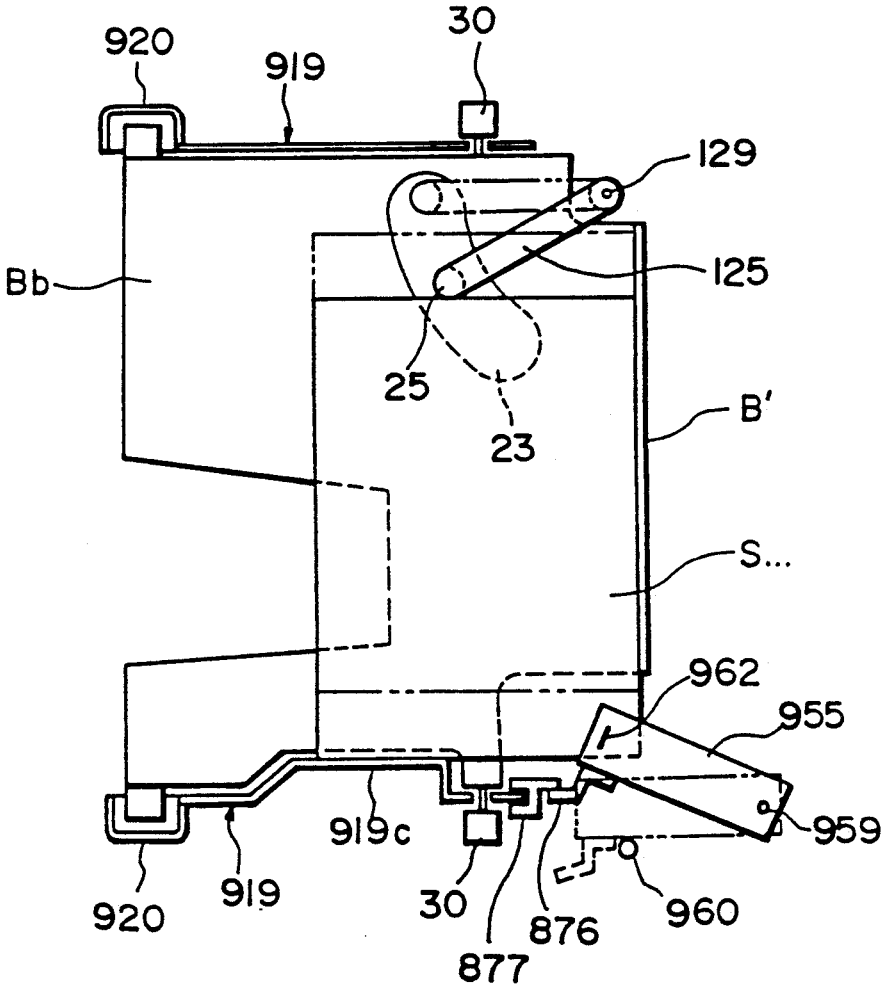
FIG. 37 is a plan view illustrating sheet alignment and stapler positioning in the apparatus of FIG. 36.

Referring to FIGS. 36 and 37, another embodiment will be described wherein the mechanism for positioning the automatic stapler 955 at the stapling position is partly modified.

In this embodiment, a frame guide 877 for guiding the bin frame 919 is disposed at the front side of the sorter 6, and an end of a bin frame 919 is slidably engaged in a guiding groove **877*a* of the frame guide 877**.

On the other hand, the automatic stapler 955 has a stapling position stopper 876 fixedly mounted thereto, which abuts the frame guide 877 to position automatic stapler 955 at its stapling position when it is moved to the stapling position.

In the operation, when a sheet S is discharged onto the bin B, the sheet S is aligned along a sheet alignment reference 919*c* of the bin frame 919 correctly positioned by the frame guide 877, as shown in FIG. 37.

When the sheet stapling operation is carried out, the stapler 955 is moved to the stapling position and is abutted to and positioned by the frame guide 877 for guiding and positioning the sheet alignment reference 919*c*, so that the sheet accommodated in the bin B is stapled.

In this embodiment, the sorter has vertically movable bins, wherein the stapler is positioned and rotatable at a predetermined level. However, the sorter may be of a stationary bin type, and the stapler may be of an elevatable type.

As described in the foregoing, according to this embodiment, a sheet alignment reference member is provided which functions as a reference for aligning the sheets, and a portion substantially integral with the sheet alignment reference member functions as means for positioning the stapler at the stapling position, whereby the stapling position of the stapler can be correctly determined relative to the sheets, and therefore the sheets can be correctly and assuredly stapled.

Figure 38:
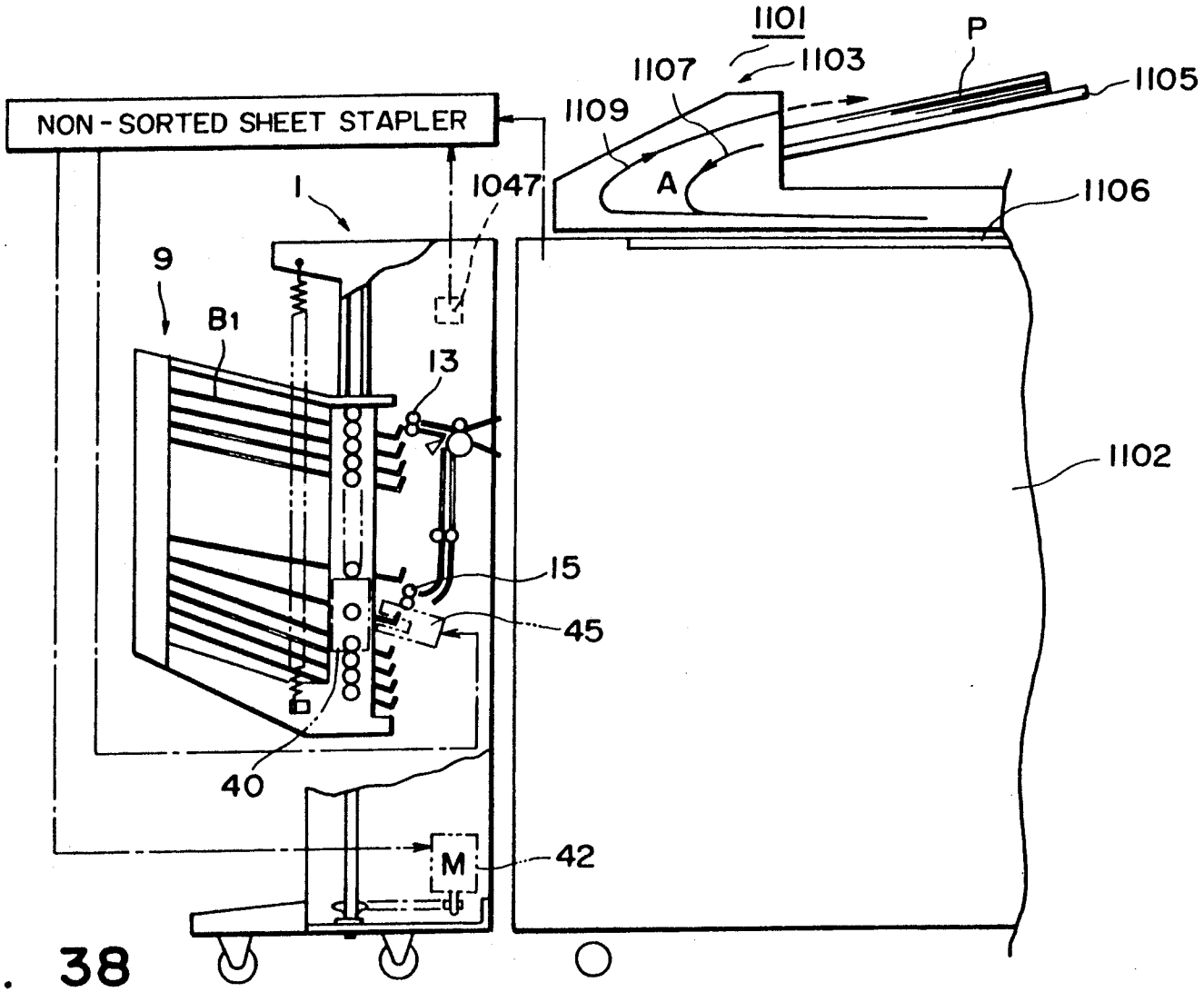
FIG. 38 is a side view of an image forming unit illustrating a non-sort stapler.

Referring to FIG. 38, the description will be made as to the operation when the sheets are stapled in the non-sort mode operation.

As shown in FIG. 38, an image forming unit 1101 includes a copying apparatus 1102, an automatic original or document feeder 1103 disposed above the copying machine 1102 and a sheet sorter disposed at one side of the copying machine 1102.

Documents or originals P placed on an original stacking tray 1105 of the automatic document feeder 1103 are separated in order from the bottom, and are fed one by one through a passage 1107 onto the platen glass 1106 of the copying machine 1102. The original is read by an optical system of the copying machine 1102. After it is read, it is returned from on the platen glass 1106 to the topmost of the original stacking tray 1105.

A sheet S having received an image of the original P transferred thereto is discharged to the sorter 1 depending on the number of copies to be taken, the selection of mode from the sort mode and non-sort mode or the like.

Figure 39:
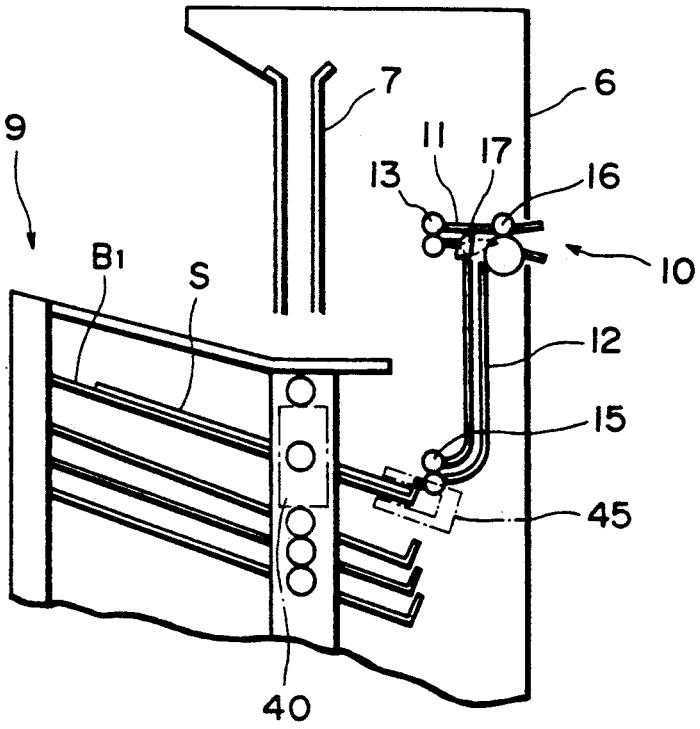
FIG. 39 is a side view of a sorter illustrating a stapling operation in a non-sort mode.

The sorter 1 is provided with a non-sort stapling controller 1046 for stapling non-sorted sheets. The controller 1046 is effective to control the above-described bin unit 9 and the electric stapler 49 when the sheets S are discharged onto the first bin B1 from the upper discharging roller couple 13 in the non-sort mode. When a selection is made to staple the sheets S on the first bin B1 by a preselected mode or after the sheets S are discharged onto the first bin B1, the controller 1046 causes movement of the bin unit 9 so that the first bin B1 accommodating the sheets S is faced to the lower discharging roller couple 15, as shown in FIG. 39, and causes the electric stapler 45 to perform the stapling operation to the sheets S on the first bin B1 now faced to the lower discharging roller couple 15.

A reference numeral 1047 in FIG. 38 designates a manual stapling switch.

Figure 41A:
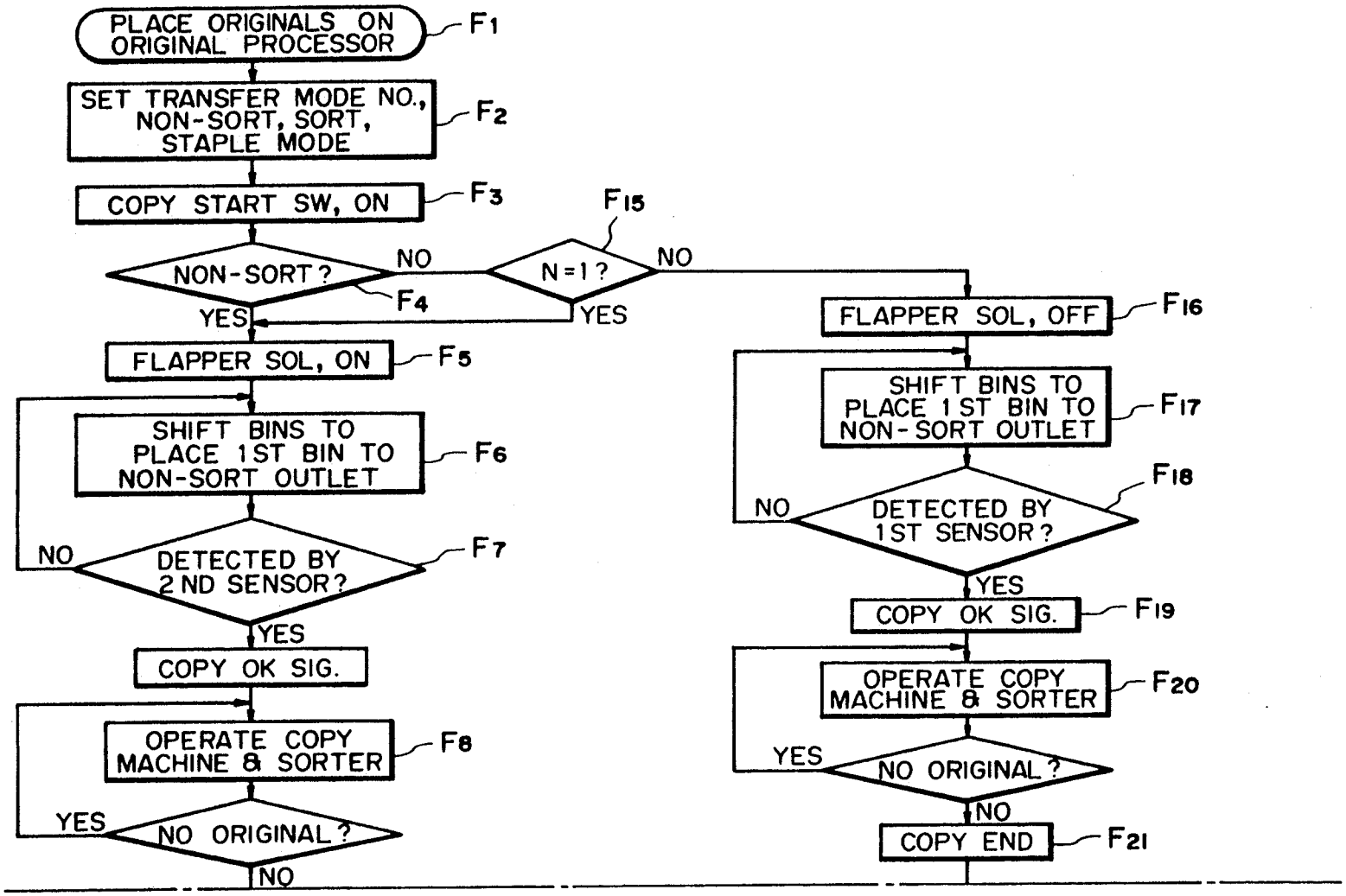
FIGS. 41, 41A, and 41B are flow charts illustrating operation of the image forming unit.
Figure 41B:
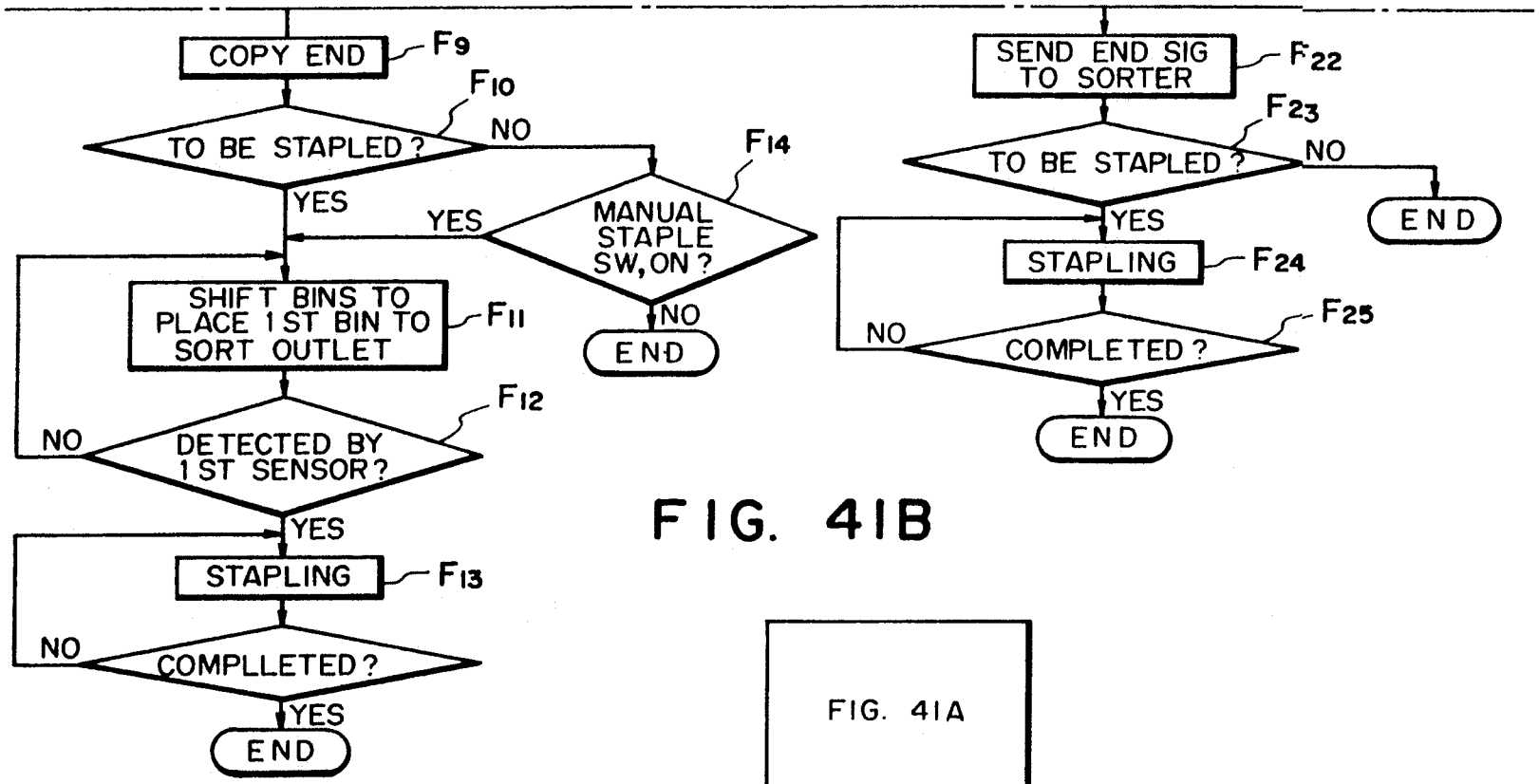
Figure 41:
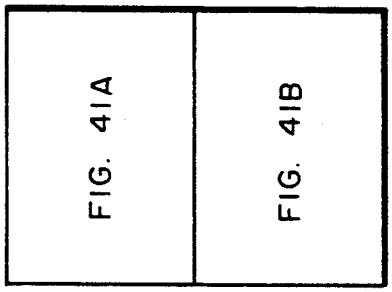

The operation will be described in conjunction with FIG. 41.

Originals P are placed on the automatic document feeder 1103 (F1). Then, the operator inputs into the copying machine 1102 a copying mode, a number to be copied, sort or non-sort mode selection and stapling or non-stapling mode selection (F2). When a copy start switch is actuated (F3), the copying machine discriminates the copying mode (a simplex copy, for example) and the sorter 1 discriminates whether the sort mode or non-sort mode is selected (F4).

When the non-sort mode is selected, the solenoid is actuated (F5) to shift the deflector 17 of the sorter 1 to direct the sheet (transfer sheet) S to the first sheet passage 11. The bin unit 9 is moved until the first bin B1 is opposed to the upper discharging roller couple 13 (F6). The bin unit 9 is provided with a flag on the bin supporting frame 19 at this position, so that when the bin unit 9 moves to such an extent that the first bin B1 reaches this position, an unshown second sensor detects the flag.

When the number of copies to be taken is 1, one sheet S for one original P is discharged by the upper discharging roller couple to the first bin B1.

When the number is plural, a preset number of the sheets S for one original P are discharged from the upper discharging roller couple 13 to the first bin B1.

Usually, the number of copies to be taken is single in the non-sort mode, and the following description will be made in this case with the stapling mode selected.

In response to detection signal from the second sensor (F7), the copying machine 1102 starts the copying operation (F8). Then, the originals P are sequentially fed from the automatic document feeder 1103, and the sheets S are discharged onto the first bin B1 until a document feeder empty signal is transmitted to a controlling station of the copying machine 1102. After the signal is received by the controlling station, the copying operation to the last original P is completed (F9). Then, the sorter 1 receives a copy completion signal. The description is made as to whether the sheets S are to be stapled or not (F16). When the stapling mode is selected, the bin unit 9 is moved after the last sheet S is received, until the first bin B1 is faced to the stapling position adjacent to the lower discharging roller couple 15 (F11). The position of the first bin B1 in this stapling position is the same as the position of the first bin B1 faced to the lower discharging roller couple 15 to receive the sheets in the sort mode (FIG. 5), and the first sensor corresponding to this position detects the flag of the bin supporting frame 19 (F12) to control the bin position.

After completion of this movement of the bin unit 9, the electric stapler 45 operates (F13) to staple the sheets S which have been discharged by the upper discharging roller couple 13 and have been accommodated on the first bin B1.

If the operator selects the non-sort mode at the initial mode setting, but wants to staple them after the sheets P are discharged to the first bin B1 by the upper discharging roller couple 13, the manual stapling switch 1047 shown in FIG. 38 is actuated (F14). In response to a signal indicative of this, the bin unit 9 moves until the first bin B1 reaches the position corresponding to the stapling position, and thereafter, the stapling operation is effected in the similar manner (F13).

The operations in the non-sort mode have been described, and the next description is concerned with the sort mode.

First, the description is made as to whether the number of copies to be copied is single or not (F15). If the number is single, the control same as that of the non-sort mode is automatically selected. If the number is plural, the solenoid is not energized after the copy starting switch is actuated (F16). Therefore, the deflector 17 directs the sheet to the second sheet passage 12. The bin unit 9 is moved so that the first bin B1 is placed opposed to the lower discharging roller couple 15 to receive the sheets S on the first bin B1 (F17). This position is detected by the first sensor in the manner similar to described above (F18). After the movement of the bins, copy start permitting signal is produced (F19), in response to which operations of the copying machine 1102 and the sorter 1 start (F20). The sheets S corresponding to the originals P are continued to be discharged until no-document signal is transmitted to the controlling station of the copying machine 1102, and the sheets are sorted and accommodated on the number of bins equal to the number of copies to be taken. After the no-document signal is received by the controlling station, the copying operation to the last original is completed (F21). The sorter 1 receives the copy completion signal (F22). The controlling station discriminates whether the stapling mode is selected or not (F23). When the stapling mode is selected, the stapling operation starts with the bin which has received the last sheet (F24). After the completion of the stapling for the bin B, the sheets S on the next bin are stapled. This continues until the last bin (the first bin B1), for example, is subjected to the stapling operation, and then, the stapling completion signal is produced, and the electric stapler 45 stops (F25). If the stapling mode is not selected at the initial mode setting, but the stapling is wanted after the sheets are sorted and discharged, the operator actuates the manual stapling switch 1047 after the sheets are accommodated, similarly to the case of the non-sort mode. In response to the signal indicative of this, the stapling operation starts with the bin having received the last sheet.

It is possible in the non-sort mode that after the completion of the stapling operation, the bin is moved to a position corresponding to the first sheet passage 11 to make it easier for the operator to take the sheet out.

Figure 40:
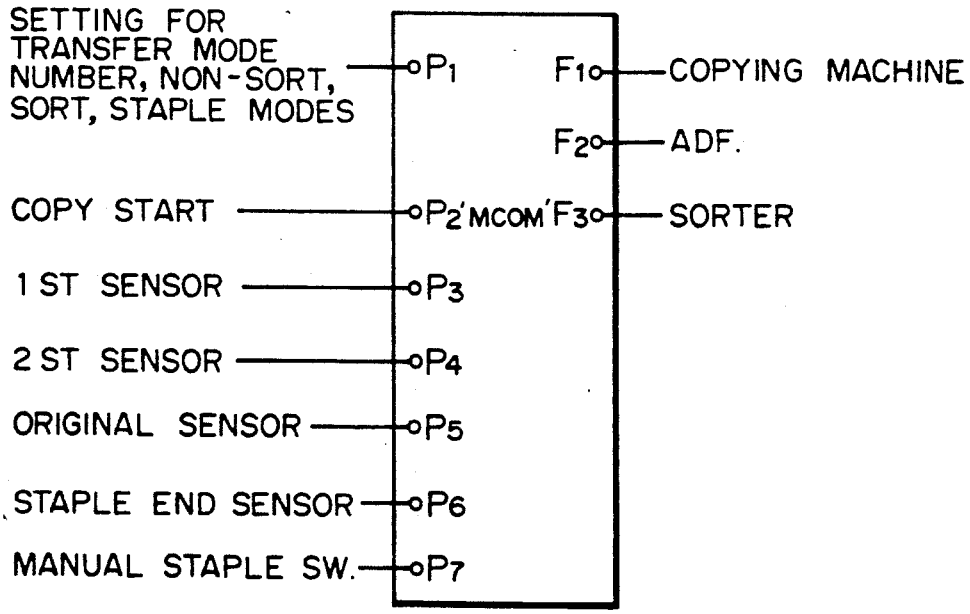
FIG. 40 is a block diagram illustrating control operation of the sorter.

The image forming unit 1101 is operated under the control of a control circuit shown in FIG. 40 which is self explanatory.

As described in the foregoing, according to this embodiment, the stapling means is disposed to the sheet discharging means for discharging the sheet to be sorted; when the stapling is wanted when the sheets are not to be sorted, the bin for receiving the non-sorted sheet opposed to the sheet discharging means for the non-sorted sheets is moved to a position for opposing to the sheet discharging means for discharging the sheet to be sorted, and the sheets thereon are sorted by the same stapling means, by the non-sort sheet stapling controller. Therefore, the non-sorted sheets are moved to a position opposing to the sheet discharging means to which the stapling means is disposed, so that the non-sorted sheets can be stapled.

Accordingly, a convenient sheet sorter can be provided.

While the invention has been described with reference to the structures disclosed herein, it is not confined to the details set forth and this application is intended to cover such modifications or changes as may come within the purposes of the improvements or the scope of the following claims.

What is claimed is:

1. A sheet sorting apparatus with a stapler, comprising:

a plurality of bin trays which are arranged substantially vertically with predetermined clearances between adjacent bin trays, said bin trays inclined to provide inclined sheet receiving surfaces and which are independently movable substantially in the vertical direction, wherein said bin trays are so disposed that between those ends of adjacent ones of said bin trays which are closed to the sheet inlet are deviated when seen in a direction substantially perpendicular to the sheet receiving surface;

bin ray shifting means for moving said plurality of the bin trays stepwisely substantially in the vertical direction to position the respective bin trays opposite to a sheet inlet of said sorting apparatus;

stapling means, disposed substantially on an extension of the inclined sheet receiving surface and having a stapling head movable to above the sheet receiving surface and an anvil movable to below the sheet receiving surface, for stapling the sheets interposed between the stapling head and the anvil;

a second shifting means for shifting the bin tray immediately above the bin tray opposed to said stapling means in a direction increasing the deviation, wherein the stapling head is moved using a space provided by the deviation, and wherein said clearance is smaller than a height of the stapling head;

detecting means, movable to a stapling position in association with movement of said stapling means, for detecting presence or absence of the sheet on the bin tray; and control means for prohibiting stapling operation of said stapling means at the stapling position and for returning said stapling means to a non-stapling position when a result of detection of said detecting means is indicative of an absence of the sheet, and for permitting the stapling operation of said stapling means at the stapling position and for returning said stapling means to the non-stapling position when the result of the detection of said detecting means is indicative of a presence of the sheet.

2. An apparatus according to claim 1, wherein said bin shifting means includes helical cam means for substantially vertically moving said bin trays by its rotation.

3. An apparatus according to claim 2, wherein said second shifting means also functions as means for guiding the bin trays in the substantial vertical direction.

4. An apparatus according to claim 3, wherein said guiding means deviated at a level opposed to the sheet inlet is shifted to provide the deviation.

5. An apparatus according to claim 2, wherein the helical cam means include a helical groove which moves said bin tray through half a height of said cam means by its one full rotation.

6. An apparatus according to claim 1, wherein said bin trays are inclined downwardly toward the sheet inlet, and said stapler is disposed adjacent the sheet inlet.

7. An apparatus according to claim 6, further comprising stopper means disposed adjacent the sheet inlet to align ends of the sheet on said bin trays.

8. An apparatus according to claim 7, wherein said bin trays are provided with cut-away portions at corners adjacent to said stapling means.

9. An apparatus according to claim 7, wherein said stopper is substantially perpendicular to the sheet receiving surface.

10. An apparatus according to claim 1, wherein the stapler head is substantially vertically movable.

11. An apparatus according to claim 1, wherein those end portions of said bin trays which are remote from the sheet inlet are rotatably and slidably supported.

12. An apparatus according to claim 11, wherein the end portions of the bin trays and those end portions which are close to the sheet inlet are both movable substantially vertically.

13. An apparatus according to claim 1, wherein said stapling means is disposed at a level corresponding to the sheet inlet.

14. An apparatus according to claim 4, further comprising two of said cam means, wherein said cam means are disposed at lateral sides of the bin with respect to a direction of sheet discharge, said cam means having respective helical grooves directed in opposite directions and are rotated in opposite directions.

15. A sheet sorting apparatus with a stapler, comprising:

a plurality of bin trays which are arranged substantially vertically with predetermined clearances between adjacent bin trays, said bin trays inclined to provide inclined sheet receiving surfaces and which are independently movable substantially in the vertical direction, wherein said bin trays are so disposed that between those ends of adjacent ones of said bin trays which are closer to the sheet inlet are deviated when seen in a direction substantially perpendicular to the sheet receiving surface;

bin tray shifting means for moving said plurality of the bin trays stepwisely substantially in the vertical direction to position the respective bin trays opposite to a sheet inlet of said sorting apparatus;

stapling means, disposed substantially on an extension of the inclined sheet receiving surface and having a stapling head movable to above the sheet receiving surface and an anvil movable to below the sheet receiving surface, for stapling the sheets interposed between the stapling head and the anvil;

a second shifting means for shifting the bin tray immediately above the bin tray opposed to said stapling means in a direction increasing the deviation, wherein the stapling head is moved uses a space provided by the deviation, and wherein said clearance is smaller than a height of the stapling head;

detecting means for detecting a presence or absence of the sheet on the bin tray;

control means for prohibiting a stapling operation of said stapling means at the stapling position and for returning said stapling means to a non-stapling position when a result of detection of said detecting means is indicative of an absence of the sheet, and for permitting the stapling operation of said stapling means at the stapling position and for returning said stapling means to the non-stapling position when the result of the detection of said detecting means is indicative of a presence of the sheet.

16. A sheet sorting apparatus with a stapler, comprising:

a plurality of bin trays which are arranged substantially vertically with predetermined clearances between the adjacent bin trays, said bin trays inclined to provide inclined sheet receiving surfaces and which are independently movable substantially in the vertical direction, wherein said bin tray are so disposed that between those ends of adjacent ones of said bin trays which are closer to the sheet inlet are deviated when seen in a direction substantially perpendicular to the sheet receiving surface;

bin tray shifting means for moving said plurality of the bin trays stepwisely substantially in the vertical direction to oppose the respective bin trays to a sheet inlet of said sorting apparatus;

stapling means, disposed substantially on an extension of the inclined sheet receiving surface and having a stapling head movable to above the sheet receiving surface and an anvil movable to below the sheet receiving surface, for stapling the sheets interposed between the stapling head and the anvil, wherein said clearance is smaller than a height of the stapling head;

detecting means, movable to a stapling position in association with movement of said stapling means, for detecting a presence or absence of the sheet on the bin tray; and control means for prohibiting a stapling operation of said stapling means at the stapling position and for returning said stapling means to a non-stapling position when a result of detection of said detecting means is indicative of an absence of the sheet, and for permitting the stapling operation of said stapling means at the stapling position and for returning said stapling means to the non-stapling position when the result of the detection of said detecting means is indicative of a presence of the sheet.

17. A sheet sorting apparatus with a stapler, comprising:

a plurality of bin trays which are arranged with predetermined clearance between adjacent bin trays, said bin trays independently movable and inclined to provide inclined sheet receiving surfaces, wherein said bin trays are so disposed that between those ends of adjacent ones of said bin trays which are closer to the sheet inlet are deviated when seen in a direction substantially perpendicular to the sheet receiving surface;

bin tray shifting means for moving said plurality of the bin trays stepwisely to position the respective bin trays to oppose a sheet inlet of said sorting apparatus;

stapling means, disposed substantially on an extension of the inclined sheet receiving surface and having a stapling head movable to above the sheet receiving surface and an anvil movable to below the sheet receiving surface, for stapling the sheets interposed between the stapling head and the anvil, wherein said clearance is smaller than a height of the stapling head;

detecting means, movable to a stapling position in association with movement of said stapling means, for detecting a presence or absence of the sheet on the bin tray; and control means for prohibiting a stapling operation of said stapling means at the stapling position and for returning said stapling means to a non-stapling position when a result of detection of said detecting means is indicative of an absence of the sheet, and for permitting the stapling operation of said stapling means at the stapling position and for returning said stapling means to the non-stapling position when the result of the detection of said detecting means is indicative of a presence of the sheet.

18. A sheet sorting apparatus with a stapler, comprising:

a plurality of bin trays which are arranged substantially vertically with predetermined clearances between adjacent bin trays, said bin trays inclined to provide inclined sheet receiving surfaces and which are independently movable substantially in the vertical direction, wherein said bin trays are so disposed that between those ends of adjacent ones of said bin trays which are closer to the sheet inlet are deviated when seen in a direction substantially perpendicular to the sheet receiving surface;

bin tray shifting means for moving said plurality of the bin trays stepwisely substantially in the vertical direction to position the respective bin trays opposite to a sheet inlet of said sorting apparatus;

stapling means, disposed substantially on an extension of the inclined sheet receiving surface and having a stapling head movable to above the sheet receiving surface and an anvil movable to below the sheet receiving surface, for stapling the sheets interposed between the stapling head and the anvil, wherein said clearance is smaller than a height of the stapling head;

detecting means for detecting a presence or absence of the sheet on the bin tray;

control means for prohibiting a stapling operation of said stapling means at the stapling position and for returning said stapling means to a non-stapling position when a result of detection of said detecting means is indicative of an absence of the sheet, and for permitting the stapling operation of said stapling means at the stapling position and for returning said stapling means to the non-stapling position and further for operating said driving means to shift said bin trays for one step when the result of the detection of said detecting means is indicative of a presence of the sheet.

19. A sheet sorting apparatus with a stapler, comprising:

a plurality of bin trays which are arranged with predetermined clearances between adjacent bin trays, said bin trays inclined to provide inclined sheet receiving surfaces and which are independently movable, wherein said bin trays are so disposed that between those ends of adjacent ones of said bin trays which are closer to the sheet inlet are deviated when seen in a direction substantially perpendicular to the sheet receiving surface;

bin tray shifting means for moving said plurality of the bin trays stepwisely to position the respective bin trays opposite to a sheet inlet of said sorting apparatus;

stapling means, disposed substantially on an extension of the inclined sheet receiving surface and having a stapling head movable to above the sheet receiving surface and an anvil movable to below the sheet receiving surface, for stapling the sheets interposed between the stapling head and the anvil, wherein said clearance is smaller than a height of the stapling head;

detecting means for detecting a presence or absence of the sheet on the bin tray;

control means for prohibiting a stapling operation of said stapling means at the stapling position and for returning said stapling means to a non-stapling position when a result of detection of said detecting means is indicative of an absence of the sheet, and for permitting the stapling operation of said stapling means at the stapling position and for returning said stapling means to the non-stapling position and further for operating said driving means to shift said bin trays by one step when the result of the detection of said detecting means is indicative of a presence of the sheet.

20. A sheet stack apparatus, comprising:

stacking means for stacking and accommodating discharged sheets;

binding means, movable between a binding position and non-binding position, for binding the sheets on said stacking means;

detecting means, movable in association with stacking means; and control means for prohibiting a binding operation of said binding means at the binding position when a result of detection of said detecting means is indicative of an absence of the sheet.

21. An apparatus according to claim 20, wherein said detecting means carries out its detecting operation before said binding means reaches the binding position.

22. A sheet stacking apparatus, comprising:

stacking means for stacking and accommodating discharged sheets;

binding means, movable between a binding position and non-binding position, for binding the sheets on said stacking means;

detecting means, movable in association with movement of said binding means to the binding position, for detecting a presence or absence of the sheets on said stacking means; and control means for prohibiting a binding operation of said binding means at the binding position and returning said binding means to the non-bonding position when a result of detection of said detecting means is indicative of an absence of the sheet.

23. An apparatus according to claim 22, wherein said detecting means carries out its detecting operation before said binding means reaches the binding position.

24. A sheet sorting apparatus, comprising:

a plurality of stacking means, arranged in multi-stage, for stacking and accommodating discharged sheets;

binding means, movable between a binding position and non-binding position, for binding the sheets on said stacking means;

detecting means, movable in association with movement of said binding means to the binding position, for detecting a presence or absence of the sheets on said stacking means; and control means for prohibiting a binding operation of said binding means at the binding position when a result of detection of said detecting means is indicative of an absence of the sheet.

25. An apparatus according to claim 24 wherein said detecting means carries out its detecting operation before said binding means reaches the binding position.

26. A sheet sorting apparatus, comprising:

a plurality of stacking means, arranged in multistage, for stacking and accommodating discharged sheets;

driving means for shifting said stacking means one by one stage;

binding means, movable between a binding position and non-binding position, for binding the sheets on said stacking means;

detecting means, movable in association with movement of said binding means to the binding position, for detecting a presence or absence of the sheets on said stacking means; and control means for prohibiting a binding operation of said binding means at the binding position and returning said binding means to the non-binding position when a result of detection of said detecting means is indicative of an absence of the sheet, said control means permitting a binding operation of said binding means and then returning said binding means to the non-binding position when the result of the detection of said detecting means is indicative of a presence of the sheet.

27. An apparatus according to claim 26, wherein said detecting means carries out its detecting operation before said binding means reaches the binding position.

28. A sheet sorting apparatus, comprising:

a plurality of stacking means, arranged in multistage, for stacking and accommodating discharged sheets;

driving means for shifting said stacking means one by one stage;

binding means, movable between a binding position and non-binding position, for binding the sheets on said stacking means;

detecting means for detecting a presence or absence of the sheets of said stacking means; and control means for prohibiting a binding operation of said binding means at the binding position and returning said binding means to the non-binding position when a result of detection of said detecting means is indicative of an absence of the sheet, said control means permitting a binding operation of said binding means and then returning said binding means to the non-binding position and then operating said driving means to shift said stacking means by one stage when the result of the detection of said detecting means is indicative of a presence of the sheet.

29. An apparatus according to claim 28, wherein said detecting means carries out its detecting operation before said binding means reaches the binding position.

30. A sheet sorting apparatus, comprising:

a plurality of stacking means, arranged in multistage, for stacking and accommodating discharged sheets;

driving means for shifting said stacking means one by one stage;

binding means, movable between a binding position and non-binding position, for binding the sheets on said stacking means;

detecting means for detecting a presence or absence of the sheets on said stacking means; and control means for prohibiting a binding operation of said binding means when a result of detection of said detecting means is indicative of an absence of the sheet, said control means permitting a binding operation of said binding means and then returning said binding means to the non-binding position and then operating said driving means to shift said stacking means by one stage when the result of the detection of said detecting means is indicative of a presence of the sheet.

31. An apparatus according to claim 30, wherein said detecting means carries out its detecting operation before said binding means reaches the binding position.

32. An apparatus according to claim 28 or 30, wherein said binding means operates each time a final sheet is discharged to said stacking means.

33. An apparatus according to claim 28 or 30, wherein a predetermined number of sheets are discharged to each of sheet receiving ones of said stacking means, and said binding means binds the sheets for respective stacking means while said driving means is shifting said stacking means.

34. An image forming apparatus, comprising:

image forming means for forming images on sheets;

stacking means for stacking and accommodating discharged sheets having images formed by said image forming means;

binding means, movable between a binding position and non-binding position, for binding the sheets on said stacking means;

detecting means, movable in association with movement of said binding means to the binding position, for detecting a presence or absence of the sheets on said stacking means; and control means for prohibiting a binding operation of said binding means at the binding position when a result of detection of said detecting means is indicative of an absence of the sheet.

35. An image forming apparatus, comprising:

image forming means for forming images on sheets;

stacking means for stacking and accommodating discharged sheets having images formed by said image forming means;

binding means, movable between a binding position and non-binding position, for binding the sheets on said stacking means;

detecting means, movable in association with movement of said binding means to the binding position, for detecting a presence or absence of the sheets on said stacking means; and control means for prohibiting a binding operation of said binding means at the binding position and returning said binding means to the non-binding position when a result of detection of said detecting means is indicative of an absence of the sheet.

36. An image forming apparatus, comprising:

image forming means for forming images on sheets;

a plurality of stacking means, arranged in multistage, for stacking and accommodating discharged sheets having images formed by sad image forming means;

binding means, movable in association with movement of said binding means to the binding position, for detecting a presence or absence of the sheets on said stacking means; and control means for prohibiting a binding operation of said binding means at the binding operation when a result of detection of said detecting means is indicative of an absence of the sheet.

37. An image formed apparatus, comprising:

image forming means for forming images on sheets;

a plurality of stacking means, arranged in multistage, for stacking and accommodating discharged sheets having images formed by said image forming means;

driving means for shifting said stacking means one by one stage;

binding means, movable between a binding position and non-binding position, for binding the sheets on said stacking means;

detecting means, movable in association with movement of said binding means to the binding position, for detecting a presence or absence of the sheets on said stacking means; and control means for prohibiting a binding operation of said binding means at the binding position and returning said binding means to the non-binding position when a result of detection of said detecting means is indicative of an absence of the sheet, said control means permitting a binding operation of said binding means and then returning said binding means to the non-binding position when the result of the detection of said detecting means is indicative of a presence of the sheet.

38. A sheet sorting apparatus, comprising:

a plurality of stacking means, arranged in multistage, for stacking and accommodating discharged sheets;

binding means, movable between a binding position and non-binding position, for binding the sheets on said stacking means;

driving means for shifting relative position between said stacking means and said binding means one by one stage;

detecting means for detecting a presence or absence of the sheets on said stacking means; and control means for prohibiting a binding operation of said binding means at the binding position and returning said binding means to the non-binding position when a result of detection of said detecting means is indicative of an absence of the sheet, said control means permitting binding operation of said binding means and then returning said binding means to the non-binding position and then operating said driving means to shift the relative position by one stage when the result of the detection of said detecting means is indicative of a presence of the sheet.

39. An image forming apparatus, comprising:

image forming means for forming images on sheets;

a plurality of stacking means, arranged in multistage, for stacking and accommodating discharged sheets having images formed by said image forming means;

driving means for shifting said stacking means one by one stage;

binding means, movable between a binding position and non-binding position, for binding the sheets on said stacking means;

detecting means for detecting a presence or absence of the sheets on said stacking means; and control means for prohibiting a binding operation of said binding means at the binding position and returning said binding means to the non-binding position when a result of detection of said detecting means is indicative of an absence of the sheet, said control means permitting a binding operation of said binding means and then returning said binding means to the non-binding position and then operating said driving means to shift said stacking means by one stage when the result of the detection of said detecting means is indicative of a presence of the sheet.

40. An image forming apparatus, comprising:

image forming means for forming images on sheets;

a plurality of stacking means, arranged in multistage, for stacking and accommodating discharged sheets having images formed by said image forming means;

driving means for shifting said stacking means one by one stage;

binding means, movable between a binding position and non-binding position, for binding the sheets on said stacking means;

detecting means for detecting a presence or absence of the sheets on said stacking means; and control means for prohibiting a binding operation of said binding means when a result of detection of said detecting means is indicative of an absence of the sheet, aid control means permitting a binding operation of said binding means and then returning said binding means to the non-binding position and then operating said driving means to shift said stacking means by one stage when the result of the detection of said detecting means is indicative of a presence of the sheet.

41. An image forming apparatus, comprising:

image forming means;

conveying means for conveying and discharging sheets processed by said image forming means;

stacking means for stacking and accommodating sheets discharged by said conveying means;

driving means for shifting said stacking means one by one stage while facing said stacking means to said conveying means;

binding means, movable between a binding position and non-binding position, for binding the sheets on said stacking means;

detecting means for detecting a presence or absence of the sheets on said stacking means;

control means for prohibiting a binding operation of said binding means at the binding position and returning said binding means to the non-binding position when a result of detection of said detecting means is indicative of an absence of the sheet, said control means permitting binding operation of said binding means and then returning said binding means to the non-binding position and then operating said driving means to shift said stacking means by one stage and then controlling said driving means and said binding means to repeat operation of said binding means when the result of the detection of said detecting means is indicative of a presence of the sheet.

* * * * *

UNITED STATES PATENT AND TRADEMARK OFFICE

CERTIFICATE OF CORRECTION

PATENT NO. : 5,152,511

DATED : October 6, 1992

INVENTOR(S) : SHIDO et al.

It is certified that error appears in the above-identified patent and that said Letters Patent is hereby corrected as shown below:

ON THE TITLE PAGE

[56] REFERENCES CITED

U.S. PATENT DOCUMENTS

"4,762,312 8/1988 Ushinogata" should read --4,762,312 8/1988 Ushirogata--.

FOREIGN PATENT DOCUMENTS

"0099250 9/1984 European Pat. Off" should read --0099250 1/1984 European Pat. Off.--

"62-119069 4/1987 Japan" should read --62-119069 5/1987--.

IN THE DRAWINGS

FIGURE 41B

"COMPLLETED?" should read --COMPLETED?--.

UNITED STATES PATENT AND TRADEMARK OFFICE

CERTIFICATE OF CORRECTION

PATENT NO. : 5,152,511

DATED : October 6, 1992

INVENTOR(S) : SHIDO et al.

It is certified that error appears in the above-identified patent and that said Letters Patent is hereby corrected as shown below:

COLUMN 1

Line 43, "the" (third occurrence) should be deleted.

COLUMN 3

Line 60, "discharging" should read --discharging roller--.

COLUMN 5

Line 42, "relationships" should read --relationship--.

COLUMN 6

Line 42, "direction" should read --direction and--.

Line 49, "nonsort" should read --non-sort--.

COLUMN 8

Line 68, "nated" should read --nates--.

COLUMN 11

Line 41, "(FIG. 17)" should read --(FIG. 17).--.

UNITED STATES PATENT AND TRADEMARK OFFICE

CERTIFICATE OF CORRECTION

PATENT NO. : 5,152,511

DATED : October 6, 1992

INVENTOR(S) : SHIDO et al.

It is certified that error appears in the above-identified patent and that said Letters Patent is hereby corrected as shown below:

COLUMN 13

Line 6, "in advertently" should read --inadvertently--.

COLUMN 22

Line 35, "clearance" should read --clearances--.

COLUMN 24

Line 14, "with stack-" should read --with movement of said binding means to the binding position, for detecting a presence or absence of the sheets on said stack- --.

Line 57, "claim 24" should read --claim 24,--.

Line 61, "multistage," should read --multi-stage,--.

COLUMN 25

Line 19, "multistage," should read --multi-stage,--.

Line 46, "multistage," should read --multi-stage,--.

UNITED STATES PATENT AND TRADEMARK OFFICE

CERTIFICATE OF CORRECTION

PATENT NO. : 5,152,511

DATED : October 6, 1992

INVENTOR(S) : SHIDO et al.

It is certified that error appears in the above-identified patent and that said Letters Patent is hereby corrected as shown below:

COLUMN 26

Line 46, "multistage," should read --multi-stage,--.

Line 50, "movable in" should read --movable between a binding position and non-binding position, for binding the sheets on said stacking means;

¶ detecting means, movable in--.

Line 55, "operation" should read --position--.

Line 60, "multistage," should read --multi-stage,--.

COLUMN 27

Line 16, "multistage," should read --multi-stage,--.

Line 41, "multistage," should read --multi-stage,--.

COLUMN 28

Line 8, "multistage," should read --multi-stage,--.

Line 22, "aid" should read --said--

Signed and Sealed this

Twenty-first Day of June, 1994

Bruce Lehman

*Attest:*

BRUCE LEHMAN

*Attesting Officer*

*Commissioner of Patents and Trademarks*